US008096636B2

(12) United States Patent
Katoh

(10) Patent No.: US 8,096,636 B2
(45) Date of Patent: Jan. 17, 2012

(54) WASTE LIQUID STORAGE CONTAINER, WASTE LIQUID DISCHARGE DEVICE, AND IMAGE FORMATION APPARATUS

(75) Inventor: Tomomi Katoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 970 days.

(21) Appl. No.: 11/879,697

(22) Filed: Jul. 18, 2007

(65) Prior Publication Data

US 2008/0158294 A1 Jul. 3, 2008

(30) Foreign Application Priority Data

Jul. 19, 2006 (JP) ..... 2006-196768
Feb. 14, 2007 (JP) ..... 2007-034022

(51) Int. Cl.
*B41J 2/165* (2006.01)

(52) U.S. Cl. ..... 347/36

(58) Field of Classification Search ..... 347/36
See application file for complete search history.

(56) References Cited

U.S. PATENT DOCUMENTS

| | | | |
|---|---|---|---|
| 5,831,647 | A | 11/1998 | Kawakami et al. |
| 6,281,911 | B1 | 8/2001 | Nakazawa et al. |
| 6,682,185 | B2 | 1/2004 | Hashimoto et al. |
| 6,913,348 | B2 | 7/2005 | Hashimoto et al. |
| 2003/0202038 | A1 | 10/2003 | Oku |
| 2005/0116997 | A1 | 6/2005 | Katoh et al. |

FOREIGN PATENT DOCUMENTS

| | | | |
|---|---|---|---|
| EP | 0744300 | A2 | 11/1996 |
| EP | 0928694 | A1 | 7/1999 |
| EP | 1356942 | A1 | 10/2003 |
| JP | 60-11363 | | 1/1985 |
| JP | 60-147344 | | 8/1985 |
| JP | 3-175048 | | 7/1991 |
| JP | 4-211963 | | 8/1992 |
| JP | 6-32923 | | 5/1994 |
| JP | 7-314729 | | 12/1995 |
| JP | 10-244665 | | 9/1998 |
| JP | 2000-15826 | | 1/2000 |
| JP | 2001-171148 | | 6/2001 |
| JP | 2002-361899 | | 12/2002 |
| JP | 2004-306384 | | 11/2004 |
| JP | 2005-119210 | | 5/2005 |

OTHER PUBLICATIONS

Nov. 12, 2007 European search report in connection with corresponding European patent application No. 07 25 2816.

*Primary Examiner* — Jerry Rahll
(74) *Attorney, Agent, or Firm* — Cooper & Dunham LLP

(57) ABSTRACT

A disclosed waste liquid storage container includes: a container body divided into plural segments; and a waste liquid absorption member disposed on each segment of the container body, the waste liquid absorption member being made of a high water-absorbing polymer or a high oil-absorbing polymer.

14 Claims, 20 Drawing Sheets

WASTE LIQUID STORAGE CONTAINER, WASTE LIQUID DISCHARGE DEVICE, AND IMAGE FORMATION APPARATUS

BACKGROUND

1. Technical Field

This disclosure relates to a waste liquid storage container, a waste liquid discharge device, and an image formation apparatus.

2. Description of the Related Art

Nowadays, waste liquids are collected and disposed of in various situations. For example, automobiles and machine tools generate waste oil upon changing oil. In the medical field, it is necessary to collect and dispose of body fluids such as blood and the like. There are various types of collection methods in which liquid is collected as is in a container, liquid is solidified and disposed of as in cases of edible oil, waste liquid is sent to a waste liquid collection unit built in a device and a waste liquid absorption unit is replaced, or the like. In each case, a common object regarding waste liquid disposal is how to collect waste liquid without spilling it out of a container.

The following describes the common object mentioned above referring to an image formation apparatus provided with a liquid discharge device as an example. In general, image formation apparatuses having functions of a printer, fax machine, copier, plotter, or multi-functionality of these functions use the liquid discharge device including a recording head constructed with a liquid discharge head for discharging droplets of recording fluid (liquid), for example. While transferring a medium (hereafter also referred to as "paper" without limiting materials and a recorded medium, recording medium, transfer material, recording paper, and the like are used as having the same definition), such image formation apparatuses perform image formation (recording, printing, photo printing, and character printing are used as having the same definition) by attaching recording fluid (hereafter also referred to as ink) to paper as liquid.

The expression "image formation apparatuses" refers to apparatuses for performing image formation by discharging liquid to a medium such as paper, string, fiber, fabric, leather, metal, plastic, glass, wood, ceramics, and the like. The expression "image formation" not only refers to providing images having meaning such as characters, figure, and the like to the medium, but also refers to providing images having no meaning such as patterns to the medium. Further, the word "liquid" is not limited to the recording fluid or ink as long as it is fluid when discharged. Moreover, the liquid discharge device refers to a device for discharging liquid from a liquid discharge head and is not limited to image formation.

Liquid discharge devices and image formation apparatuses using such a liquid discharge head require a mechanism for maintaining and recovering capability of the liquid discharge head for discharging recording fluid. Main functions of the mechanism for maintaining and recovering capability of the head include a cap function for covering with a cap member having high sealing characteristics so as to prevent thickening and fixation of the recording fluid resulting from natural evaporation of ink in the vicinity of nozzle openings, a discharge recovery function for recovering from discharge failure due to air bubbles and the like generated in the nozzle openings by ejecting the recording fluid and for performing suction and ejection of the recording fluid from the nozzle of the head through the cap function, and a wiping function for wiping out remaining recording fluid attached on a nozzle surface which may cause a change of flight conditions of droplets.

By performing such an operation for maintaining and recovering the capability of the head, recording fluid unused for recording (image formation) is ejected as waste recording fluid. Some maintenance and recovery mechanisms include a waste liquid storage container (also referred to as a waste liquid tank, waste liquid storage unit, and the like) for accumulating and storing the waste recording fluid and a fill-up detection sensor for detecting fill-up of the waste liquid storage container.

Patent Document 1: Japanese Laid-Open Patent Application No. 2005-119210

Patent Documents 2 and 3 disclose collection of waste liquid in an ink cartridge.

Patent Document 2: Japanese Laid-Open Patent Application No. 3-175048

Patent Document 3: Japanese Laid-Open Patent Application No. 4-211963

Patent Documents 4 and 5 disclose a waste liquid storage container storing a porous sponge body and a felt material disposed on a portion of an apparatus in which waste ink is collected in the waste liquid storage container.

Patent Document 4: Japanese Laid-Open Patent Application No. 60-011363

Patent Document 5: Japanese Laid-Open Patent Application No. 6-32923

Patent Document 6 discloses high water-absorbing polymers used as absorbent stored in an accumulation space of an accumulation unit.

Patent Document 6: Japanese Laid-Open Patent Application No. 10-244665

In recent years, it has become difficult to secure a space for the waste liquid storage container as image formation apparatuses have been downsized and a waste liquid absorber is directly disposed on a bottom of a device housing without using a container, for example. In this case, the bottom of the device housing usually has a complicated shape with concavity and convexity, so that this poses problems in that the waste liquid absorber needs to be processed to have such a complicated shape in order to be disposed in accordance with the complicated shape, design of the waste liquid absorber is greatly limited, and the like.

In particular, conventionally used waste liquid absorbers made of the porous sponge body and the felt material have a small amount of waste liquid which can be absorbed relative to a space occupied by the waste liquid absorber, so that this poor efficiency of space is problematic.

In this case, by using high water-absorbing polymers as disclosed in Patent Document 5, it is possible to substantially improve the space efficiency of waste liquid absorption. However, an image formation apparatus disclosed in Patent Document 5 only solves a problem of disposing of a large amount of waste ink in an ink-jet printer for fabric. It is impossible to apply this to small-sized image formation apparatuses used in homes and offices without change and there is a problem in that polymers are unevenly located in a certain portion of the accumulation space, so that waste liquid may not be collected at an early stage.

BRIEF SUMMARY

In an aspect of this disclosure, there are provided a waste liquid storage container and an image formation apparatus provided with the waste liquid storage container in which absorption efficiency of an amount of waste liquid is improved relative to a volume of a container, manufacturing is readily possible, and waste liquid is stably stored over a long period of time.

According to another aspect, there is provided a waste liquid storage container comprising: a container body divided into plural segments; and a waste liquid absorption member disposed on each segment of the container body, the waste liquid absorption member being made of high water-absorbing polymers or high oil-absorbing polymers.

According to another aspect, in the waste liquid storage container, the polymers may have a powder shape, flake shape, fibrous shape, gel shape, or fragment shape. A communication portion for communicating with adjacent segments may be formed on a partition portion dividing the container body into the segments. And, the communication portion may be disposed on a position which is not closed when the polymers are swelled.

According to another aspect, in the waste liquid storage container, a height of a partition portion dividing the container body into the segments may be lower than a height of an outermost wall portion of the container body. A lid member for covering the container body may be installed so as to be capable of sealing the container body. In this case, preferably, at least a portion of the lid member is made of a porous material.

According to another aspect, in the waste liquid storage container, the polymers may be disposed on a wall surface of the segment. A frame member may be disposed on the segment, the frame member having a waste liquid absorption member made of high water-absorbing polymers or high oil-absorbing polymers disposed thereon. And, the container body may be constructed using a housing of a body of an apparatus including the waste liquid storage container.

According to another aspect, in the waste liquid storage container, a concave portion or a convex portion may be continuously formed on a top surface of a partition portion dividing the container body into the segments. Or, a step portion may be continuously formed on an inner wall side of a top surface of a partition portion dividing the container body into the segments.

According to another aspect, there are provided a liquid discharge device and an image formation apparatus comprising the waste liquid storage container according to the present invention.

According to another aspect, in the image formation apparatus, the waste liquid storage container may be installed in a detachable manner. And the image formation apparatus may include a detection unit detecting an amount of waste liquid in the waste liquid storage container.

The aforementioned waste liquid storage container comprises: the container body divided into plural segments; and the waste liquid absorption member disposed on each segment of the container body, the waste liquid absorption member being made of high water-absorbing polymers or high oil-absorbing polymers. Thus, absorption efficiency of an amount of waste liquid is improved relative to a volume of the container, manufacturing is readily made, polymers are prevented from being unevenly located in a portion of the container body, and waste liquid is stably stored over a long period of time.

The aforementioned liquid discharge device and image formation apparatus include the aforementioned waste liquid storage container. Thus, it is possible to stably store waste recording fluid over a long period of time.

Other aspects, features and advantage will become more apparent from the following detailed description when read in conjunction with the accompanying drawings.

DETAILED DESCRIPTION OF THE PREFERRED EMBODIMENTS

Figure 1:
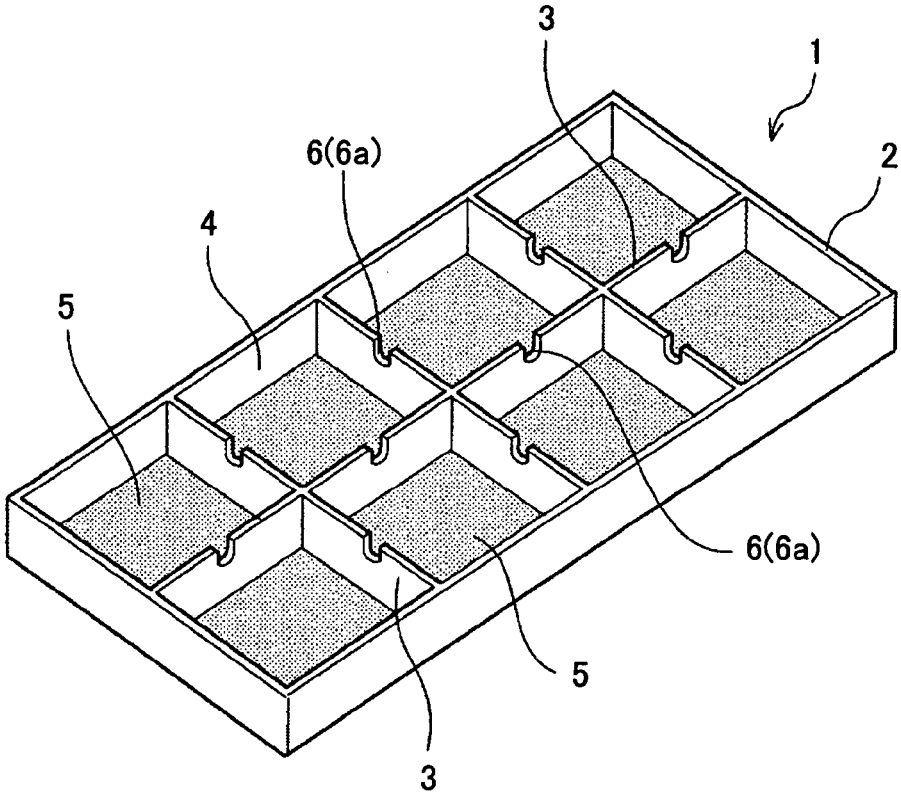
FIG. 1 is a perspective view showing a first embodiment of a waste liquid storage container according to the present invention.
Figure 2:
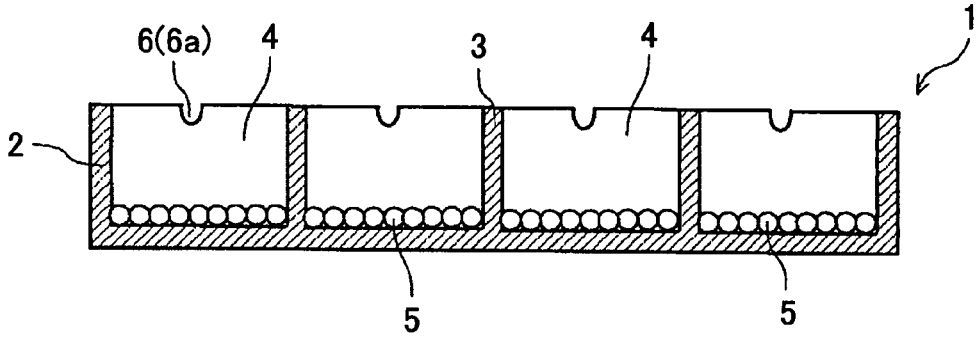
FIG. 2 is a cross-sectional view illustrating a main portion of FIG. 1.

In the following, embodiments of the present invention will be described with reference to the accompanying drawings. In the following, a first embodiment of a waste liquid storage container according to the present invention is described with reference to FIGS. 1 and 2. FIG. 1 is a perspective view showing the waste liquid storage container and FIG. 2 is a cross-sectional view illustrating the waste liquid storage container.

In a waste liquid storage container 1, an internal space of a container body 2 is divided into plural portions 4 (referred to as segments) by being defined by a rib 3 as plural partition portions. In each segment 4, a waste liquid absorption member 5 made of high water-absorbing polymers (or high oil-absorbing polymers) is disposed. Further, in the rib 3, a communication portion 6 is formed using a notch portion 6*a* for communicating with adjacent segments 4.

Although any types of materials such as resin, metal, ceramics, and the like may be used for the container body 2, resin that is not subject to corrosion from waste liquid is most preferable. In this case, in the container body 2 having a rectangular shape in a planar shape, the rib 3 is perpendicularly and laterally formed so as to form the segment 4 having a substantially rectangular shape. In addition, the shapes of the container body 2 and each segment 4 are not limited to such a rectangular shape in a planar shape.

By defining (dividing) the internal space of the container body 2 into plural segments 4 using the rib 3, strength of the container is improved and movement of the waste liquid absorption member 5 stored in the container body 2 is limited within one segment 4. Thus, it is possible to prevent the waste liquid absorption member 5 from being unevenly located in a portion of the waste liquid storage container 1 and to eliminate a loss of absorption function resulting therefrom.

As a material of the waste liquid absorption member 5, high polymer materials having a function for internally holding liquid are used. Water-soluble polymers and high water-absorbing polymers are preferably used in a case of aqueous liquid. Oil-soluble polymers and high oil-absorbing polymers are preferably used in a case of oil-based liquid. The expression "high water-absorbing polymers" is defined as having an amount of water absorption of 10 g or more per gram of resin and the expression "high oil-absorbing polymers" is defined as having an amount of oil absorption of 10 g or more per gram of resin.

Specifically, examples of water-soluble polymers and high water-absorbing polymers in the case of aqueous liquid include polyalkyl oxide such as polyethylene oxide, polyvinylpyrrolidone, polyvinyl alcohol, polyvinyl butyral, polyacrylic acid, γ-polyglutamic acid, polyacrylate, copolymer of isobutylene and maleic acid, polyacrylamide, polypropylene glycol, glue, gelatin, casein, albumin, gum arabic, alginic acid, sodium alginate, methylcellulose, carboxymethylcellulose, hydroxyethylcellulose, polyvinyl ether, polyvinyl methyl ether, polyethylene glycol, glucose, xylose, sucrose, maltose, arabinose, α-cyclodextrin, copolymer such as starch, graft polymer, cross-linking body, and the like. However, the water-soluble polymers and high water-absorbing polymers are not limited to these materials.

Further, examples of oil-soluble polymers and high oil-absorbing polymers in the case of oil-based liquid include petroleum polymer, rosin-modified phenol polymer, alkyd polymer, and the like. However, the oil-soluble polymers and high oil-absorbing polymers are not limited to these materials.

The materials as mentioned above are capable of absorbing liquid several times to several hundred times their volume when they are dry and the materials have high absorption efficiency, so that it is possible to reduce an amount of the material to be stored in the container in an initial stage.

Moreover, a form of the waste liquid absorption member 5 is preferably a powder shape, granular shape, flake shape, fibrous shape, gel shape, or fragment shape. By employing such a form, it is not necessary to process or form absorbent in accordance with a shape of the container. In addition, it is possible to commonly use the absorbent for containers having various different shapes so as to reduce a cost. When the waste liquid absorption member 5 is shown in an enlarged manner (FIG. 2, for example) for description, the waste liquid absorption member 5 is shown as having a spherical shape for convenience sake.

A height position of a bottom of the notch portion 6*a* constituting the communication portion 6 is formed to be substantially the same as a height of a top surface of the waste liquid absorption member 5 in a case of a maximum volume within the segment 4 divided by the rib 3.

Figure 3:
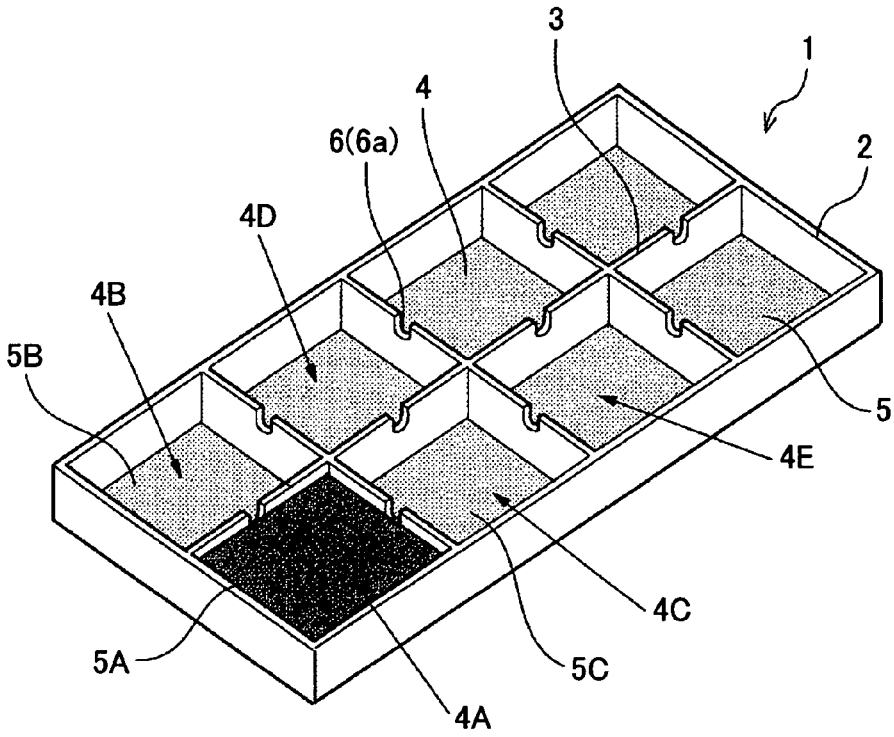
FIG. 3 is a perspective view used for illustrating effects of the embodiment.

Effects of waste liquid storage of the waste liquid storage container 1 constructed in this manner are described with reference to FIG. 3. In FIG. 3, sub-references A and B are assigned to a relevant segment and a waste liquid absorption member so as to discriminate between each segment 4 and waste liquid absorption member 5.

The waste liquid storage container 1 is used when waste liquid is dropped or allowed to flow (putting in waste liquid into the segment 4 is collectively referred to as pouring) to a single or plural segments 4 (defined portions). For example, in the example of FIG. 3, by pouring the waste liquid into a segment 4A, a waste liquid absorption member 5A in the segment 4A absorbs the waste liquid inside and is swelled.

In this case, because the communication portion 6 (notch portion 6*a*) is formed substantially at the same height as the top surface of the waste liquid absorption member 5 in the maximum volume within the segment 4A divided by the rib 3, the waste liquid exceeding an amount of absorption in the waste liquid absorption member 5A of the segment 4A is flown into adjacent segments 4B and 4C via the notch portion 6*a* and absorbed in waste liquid absorption members 5B and 5C.

Thereafter, the waste liquid is successively moved to adjacent segments 4 via the communication portion 6 in the same manner and the waste liquid is absorbed in an entire portion of the waste liquid storage container 1.

In this manner, the waste liquid storage container 1 includes the container body 2 substantially divided into plural segments and the waste liquid absorption member 5 made of high water-absorbing polymers or high oil-absorbing polymers disposed in each segment of the container body 2. Thus, absorption efficiency of an amount of waste liquid is improved relative to a volume of the container and manufacturing is readily made. Further, it is possible to prevent the polymers from being unevenly located in a portion of the container body 2 and to stably store the waste liquid over a long period of time.

In this case, by constituting the polymers into a powder shape, flake shape, fibrous shape, gel shape, or fragment shape, it is possible to apply such polymers to containers of any complicated shape. Further, it is readily possible to construct a portion of the device as a waste liquid absorption unit, enlarge a waste liquid absorption area with reduced limitation in terms of design, and prolong a life of the device which expires when the device is full of waste liquid while efficiently using a space inside the device.

Moreover, by forming the communication portion 6 such as the notch portion 6*a* (or a hole) in a portion of the rib 3 (partition portion) forming each segment 4, it is possible to move the waste liquid between adjacent segments via the communication portion 6. Thus, it is possible to move the waste liquid to a wide range field without generating unevenness of distribution and increase an amount of waste liquid that can be absorbed.

In this case, by disposing the communication portion 6 on a position which is not closed even when the waste liquid absorption member 5 is swelled, it is possible to securely move the waste liquid between the segments and increase the amount of waste liquid that can be absorbed.

Figure 4:
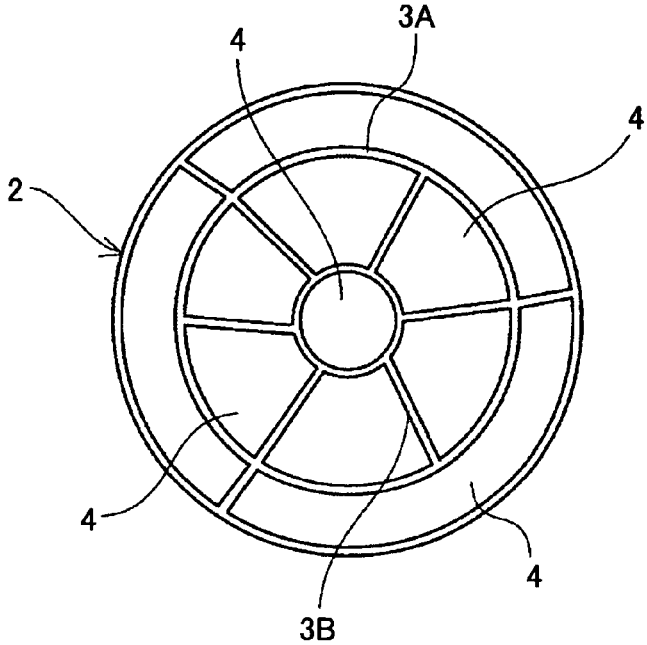
FIG. 4 is a partially enlarged plan view showing a container body of a second embodiment of a waste liquid storage container according to the present invention.

Next, a second embodiment of the waste liquid storage container according to the present invention is described with reference to FIG. 4. FIG. 4 is a partially enlarged plan view showing a container body of the waste liquid storage container.

In the present embodiment, shapes of the container body 2 and each segment 4 are defined by dividing the container body 2 having a circular shape in a planar shape into plural segments 4 using a rib 3A following a circumferential shape, a rib 3B radially disposed, and the like.

Figure 5:
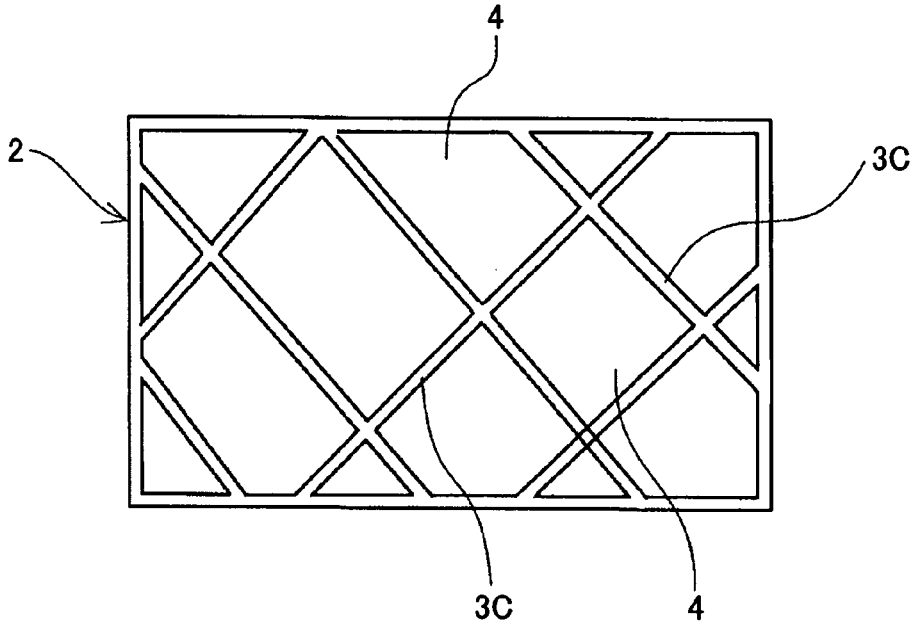
FIG. 5 is a partially enlarged plan view showing a container body of a third embodiment of a waste liquid storage container according to the present invention.

Next, a third embodiment of the waste liquid storage container according to the present invention is described with reference to FIG. 5. FIG. 5 is a partially enlarged plan view showing a container body of the waste liquid storage container.

In the present embodiment, the shapes of the container body 2 and each segment 4 are defined by dividing the container body 2 having a substantially rectangular shape in a planar shape into plural substantially parallelogrammatic segments 4 using a rib 3C obliquely disposed.

Figure 6:
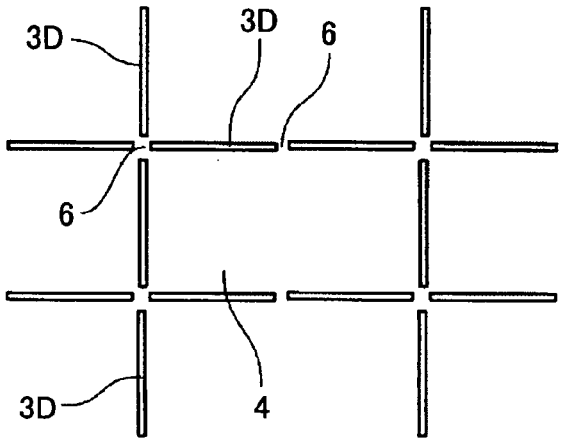
FIG. 6 is a partially enlarged plan view showing a container body of a fourth embodiment of a waste liquid storage container according to the present invention.

Next, a fourth embodiment of the waste liquid storage container according to the present invention is described with reference to FIG. 6. FIG. 6 is a partially enlarged plan view showing a container body of the waste liquid storage container.

In the present embodiment, the container body is formed by incompletely dividing segments 4 using a separate rib 3D. In this case, a slit portion formed between the separate ribs 3D functions as the communication portion 6 communicating between adjacent segments 4. In other words, all segments 4 need not to be completely divided by the rib 3D. Further, it is possible to mix completely separate segments and incompletely separate segments.

Figure 7:
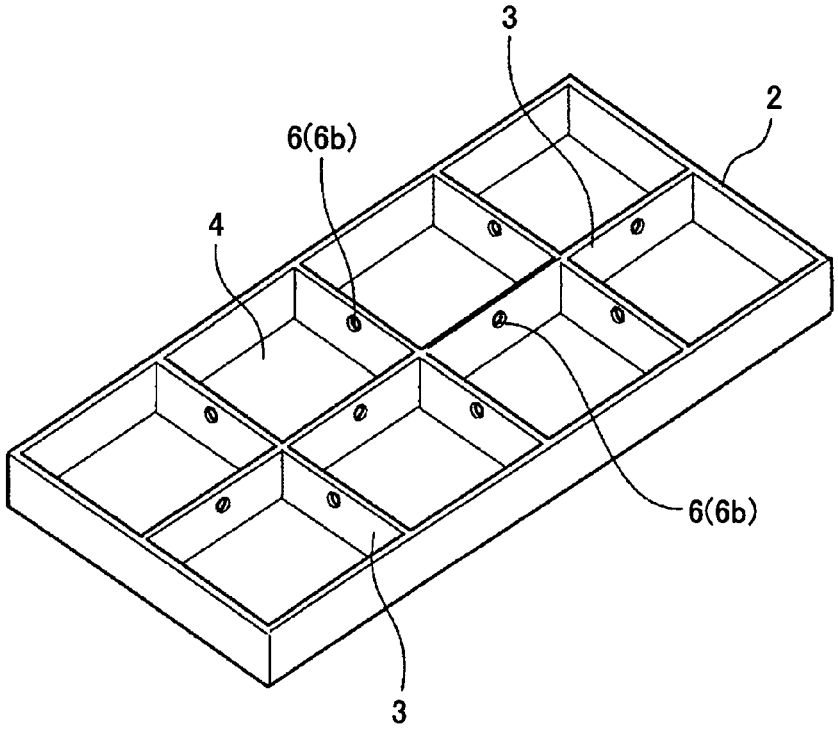
FIG. 7 is a perspective view showing a container body of a fifth embodiment of a waste liquid storage container according to the present invention.
Figure 8:
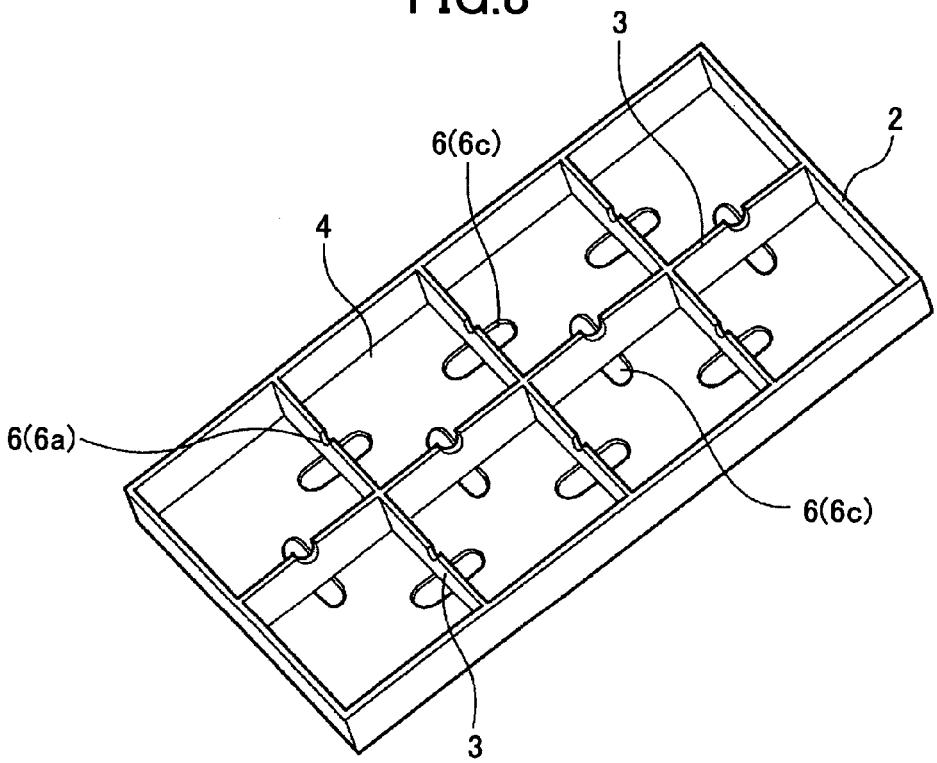
FIG. 8 is a perspective view showing a container body of a sixth embodiment of a waste liquid storage container according to the present invention.
Figure 9:
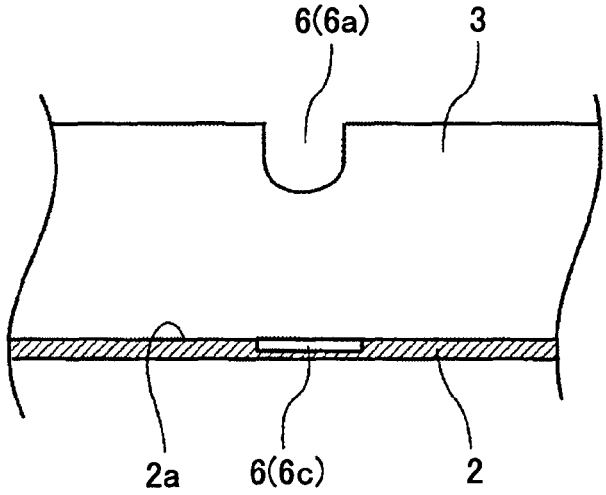
FIG. 9 is an enlarged cross-sectional view illustrating a main portion of the container body.

Next, fifth and sixth embodiments of a waste liquid storage container according to the present invention are described with reference to FIGS. 7 to 9. FIG. 7 is a perspective view showing a container body of a fifth embodiment of the waste liquid storage container according to the present invention. FIG. 8 is a perspective view showing a container body of a sixth embodiment of the waste liquid storage container according to the present invention. FIG. 9 is an enlarged cross-sectional view illustrating a main portion of the container body.

A portion for communicating with adjacent segments 4 is not limited to the communication portion 6 including the notch portion 6*a* formed in the rib 3 as in the above-mentioned embodiment. For example, the portion for communicating with the adjacent segments 4 may be a perforation 6*b* formed on the rib 3 as shown in FIG. 7 (fifth embodiment) or may be a groove 6*c* formed on a bottom 2*a* of the container body 2 as shown in FIGS. 8 and 9 (six embodiment).

When the waste liquid is transferred to the adjacent segment 4 using the above-mentioned notch portion 6*a*, perforation 6*b*, or groove 6*c*, positions and shapes thereof are determined such that the communication portion 6 such as the perforation or the groove is not closed when the waste liquid absorption member 5 absorbs the waste liquid and is swelled. In the case of the notch portion 6*a* or the perforation 6*b*, the positions are disposed above the upper surface of the waste liquid absorption member 5 when the waste liquid absorption member 5 is swelled as mentioned above or a boss may be disposed in the vicinity thereof so that the notch portion 6*a* and the perforation 6*b* are not closed. Further, when the groove 6*c* is used for communication, a groove width may be narrowed relative to the waste liquid absorption member 5 or a boss or a partition may be disposed in the vicinity of the groove 6*c* such that the waste liquid absorption member 5 is not inserted into the groove 6*c*.

Figure 10:
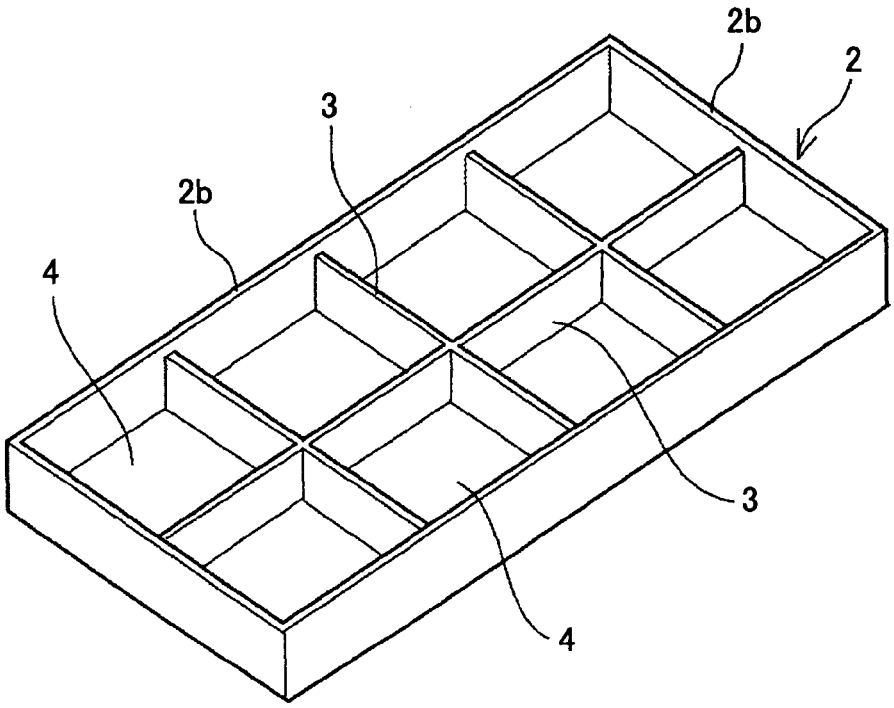
FIG. 10 is a perspective view showing a container body of a seventh embodiment of a waste liquid storage container according to the present invention.

Next, a seventh embodiment of the waste liquid storage container according to the present invention is described with reference to FIG. 10. FIG. 10 is a perspective view showing a container body of the seventh embodiment of the waste liquid storage container according to the present invention.

In the present embodiment, by making a height of an outer wall portion 2*b* of the container body 2 higher than a height of the rib 3 (namely, the height of the rib 3 is made lower than the height of the outer wall portion 2*b*), a space above the rib 3 is used as the communication portion 6. In other words, after the waste liquid is poured into the waste liquid absorption member 5 of the segment 4, when the waste liquid absorption member 5 is swelled and the container body 2 becomes full of waste liquid, the waste liquid is successively moved to the adjacent segments 4 by being allowed to flow above the rib 3. Thus, it is possible to absorb the waste liquid in the entire portion of the waste liquid storage container 1.

By constructing the container body 2 in this manner, even when the notch portion 6*a* or the perforation 6*b* is not formed on the rib 3, the waste liquid is allowed to move between the adjacent segments from above the rib 3 without being spilled out of the container. Thus, it is possible to flow the waste liquid to a wide range field without generating unevenness of distribution and increase the amount of waste liquid that can be absorbed.

Figure 11:
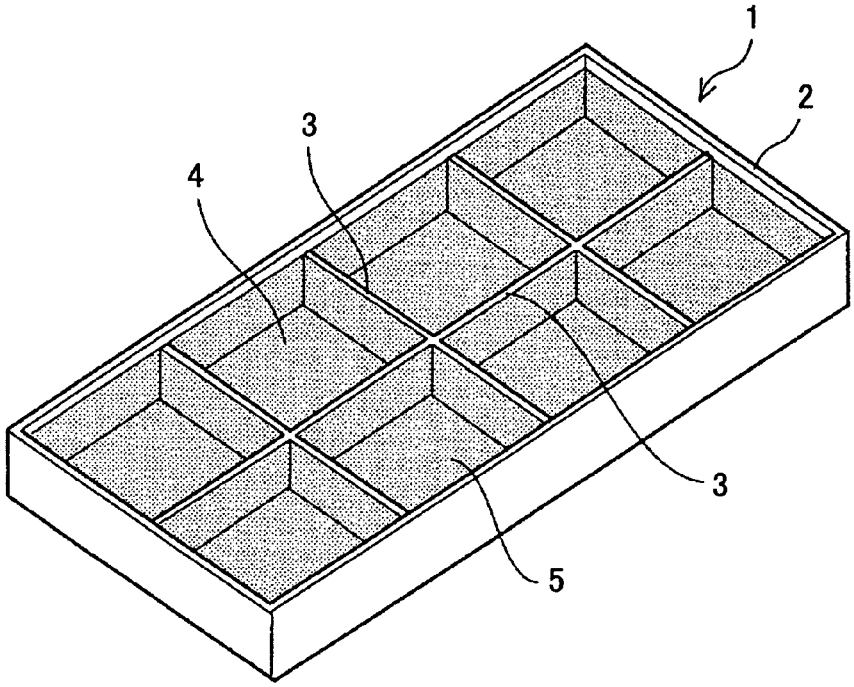
FIG. 11 is a perspective view showing a container body of an eighth embodiment of a waste liquid storage container according to the present invention.
Figure 12:
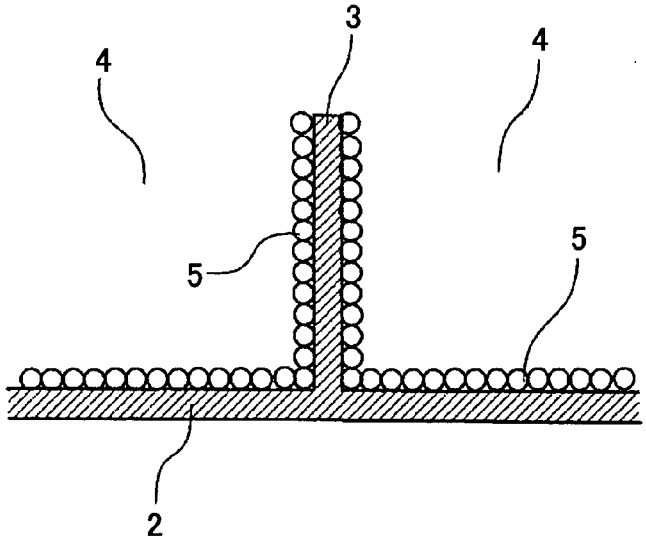
FIG. 12 is an enlarged cross-sectional view illustrating a main portion.

Next, an eighth embodiment of the waste liquid storage container according to the present invention is described with reference to FIGS. 11 and 12. FIG. 11 is a perspective view showing the waste liquid storage container according to the present embodiment. FIG. 12 is an enlarged cross-sectional view illustrating a main portion according to the present embodiment.

In the present embodiment, the waste liquid absorption member 5 (polymers) is fixed not only on a bottom of each segment 4 of the container body 2 but also on an inner surface of the outer wall portion 2*b* and a wall surface of the rib 3.

The waste liquid absorption member 5 does not need to be completely fixed but may be fixed using an adhesive substance with weak force. Accordingly, although various types of materials may be used for gluing agent, chemically-modified starch is preferably used taking into consideration environmental aspects.

Moreover, in order to have a structure where the waste liquid absorption member 5 is attached to a lower side of the inner wall surface of the container, for example, a masking member having a lattice shape is set on a top of the rib 3 inside the waste liquid storage container 1 so as to mask an upper side of the inner wall surface, the gluing agent is applied through spraying so as to coat the gluing agent onto only a desired portion, and then the waste liquid absorption member 5 having a powder shape, granular shape, flake shape, or fragment shape is applied. As a result, it is possible to manufacture the waste liquid storage container 1 as in the present embodiment.

By having such a construction, a position of high water-absorbing polymers (or high oil-absorbing polymers) is substantially fixed even when the height of the rib 3 is low and the waste liquid absorption member 5 is substantially uniformly disposed in the waste liquid storage container 1 without generating unevenness of distribution. Thus, no disparity or unevenness of distribution of the waste liquid absorption member 5 is generated, capability of absorbing waste liquid becomes stable, and failure of absorption becomes less likely to be caused. Further, when a waste liquid absorption member having a gel shape is used, a position where the waste liquid absorption member is stably disposed due to adhesiveness of the waste liquid absorption member. Moreover, by disposing the waste liquid absorption member on the wall surface of the rib 3, it is possible to increase an amount of waste liquid that can be absorbed.

Figure 13:
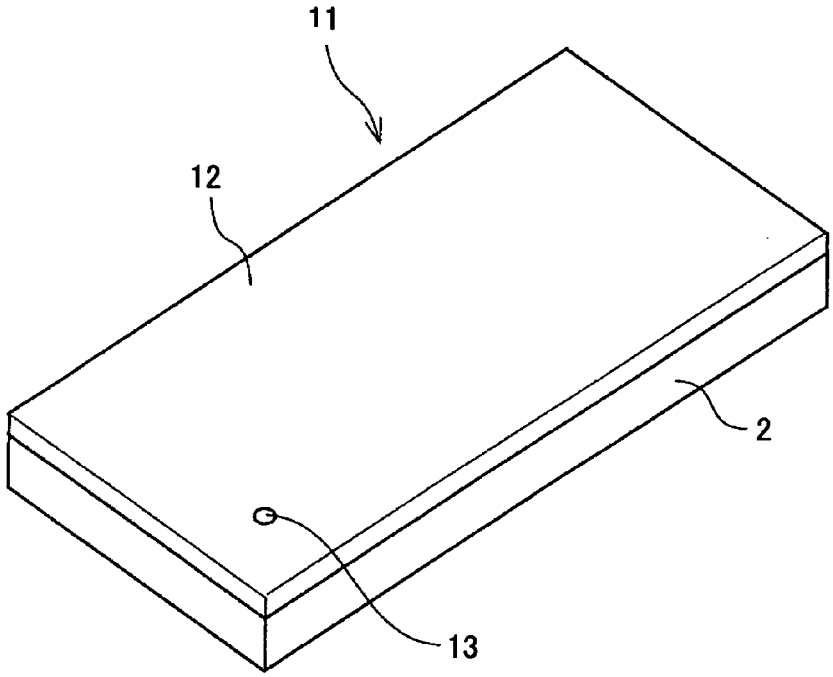
FIG. 13 is a perspective view showing a container body of a ninth embodiment of a waste liquid storage container according to the present invention.
Figure 14:
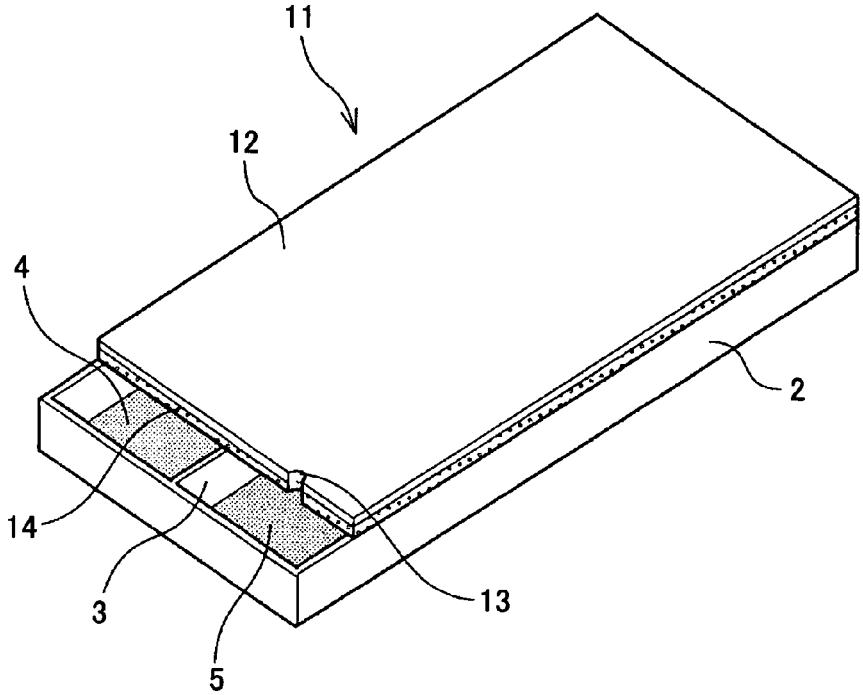
FIG. 14 is a partially cross-sectional perspective view showing the container body.

Next, a ninth embodiment of the waste liquid storage container according to the present invention is described with reference to FIGS. 13 and 14. FIG. 13 is a perspective view showing the waste liquid storage container according to the present embodiment. FIG. 14 is a partially cross-sectional perspective view showing the container body.

A waste liquid storage container 11 includes a lid member 12 for closing a top of the container body 2. In the lid member 12, a waste liquid pouring inlet (opening) 13 is formed, waste liquid is poured into a required segment 4 from the waste liquid pouring inlet 13, and the waste liquid is absorbed and stored in the waste liquid absorption member 5.

In this manner, by disposing the lid member 12 so as to improve sealing, handling of the waste liquid storage container 11 becomes facilitated when waste liquid is poured. Further, by disposing a member for closing the waste liquid pouring inlet 13, it is possible to completely prevent the waste liquid stored inside the waste liquid storage container 11 from spilling out of the container, so that handling of waste liquid becomes further facilitated.

Moreover, in the lid member 12, as shown in FIG. 14, an inner layer 14 including a porous material is formed on a lower surface on the container body 2 side. By constructing the inner layer 14 using the porous material, when the waste liquid remains in an upper portion inside the waste liquid storage container 11, it is possible to have the waste liquid less likely to be spilled out of the container even if sealing is incomplete between the segment 4 in a lower portion of the waste liquid storage container 11 and the lid member 12. Since waste liquid overflowing on the top of the lid member 12 without being absorbed in the waste liquid absorption member 5 is absorbed in the inner layer 14 including the porous material, by making at least a portion of the lid member 12 transparent, it is possible to detect a change of color so as to detect fill-up of waste liquid and absorb more waste liquid. The lid member 12 per se may include a porous material so as to only detect fill-up of waste liquid.

In this manner, by disposing the lid member 12, the sealing of the waste liquid storage container 1 is improved, so that the waste liquid is less likely to be spilled out of the container and handling of the waste liquid storage container 1 is improved when the waste liquid is stored. In this case, by using a porous material for a portion of the lid member 12, the waste liquid is even less likely to be spilled out of the container and the handling of the waste liquid storage container is improved when the waste liquid is absorbed. In addition, the waste liquid is absorbed while being transmitted in a wide range without generating unevenness of distribution due to capillary force, so that the amount of waste liquid that can be absorbed is increased. Moreover, it is possible to readily detect fill-up of waste liquid by using the change of color when the waste liquid is absorbed.

In the above-mentioned embodiments, the waste liquid is ejected to the waste liquid storage container separated as a member. However, it is possible to embed the waste liquid storage container according to the present invention in a device generating waste liquid or to integrate the waste liquid storage container with a portion of the device. For example, by employing the waste liquid storage container in the portion of the device, it is possible to replace the waste liquid storage container with a new one when the waste liquid storage container becomes full of waste liquid.

Further, by using a housing constituting the device also as the container body and constructing a structure in a member forming a bottom of the housing and components as mentioned in the embodiments described above, it is possible to secure rigidity for strength of the device housing the rib and to effectively use the space as a waste liquid collection area (waste liquid storage container).

Figure 15:
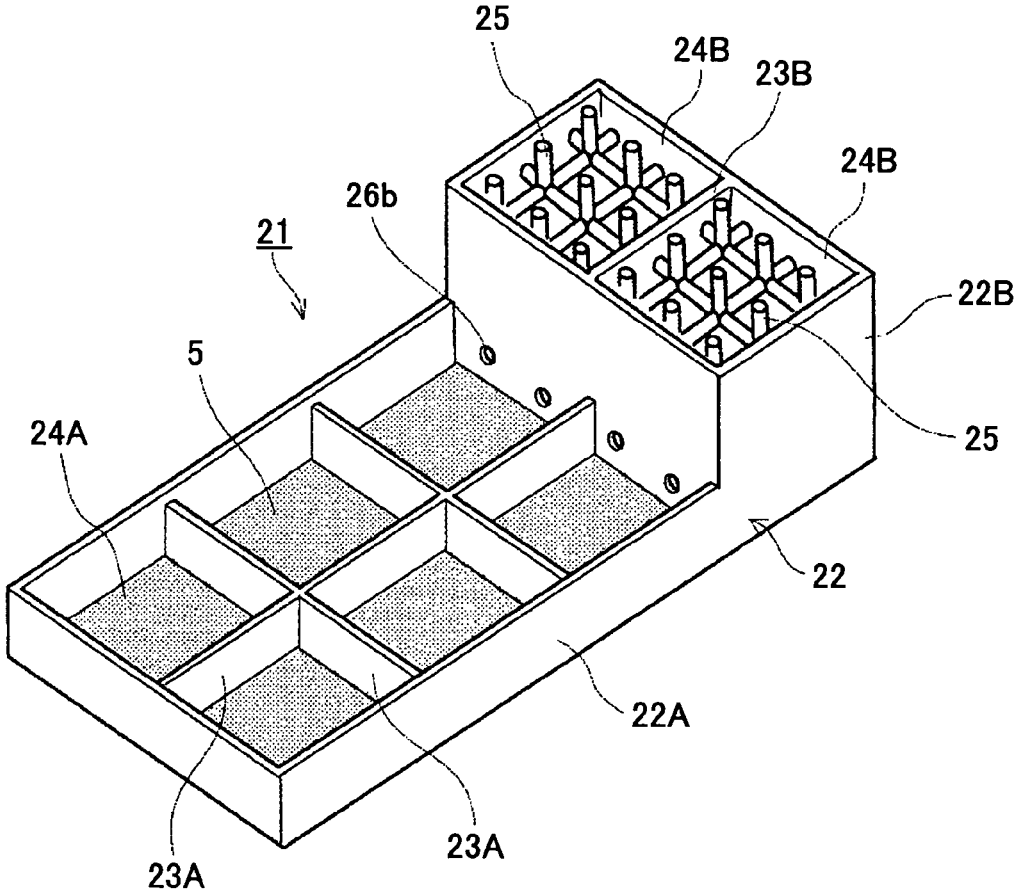
FIG. 15 is a perspective view showing a tenth embodiment of a waste liquid storage unit (waste liquid storage container) according to the present invention.
Figure 16:
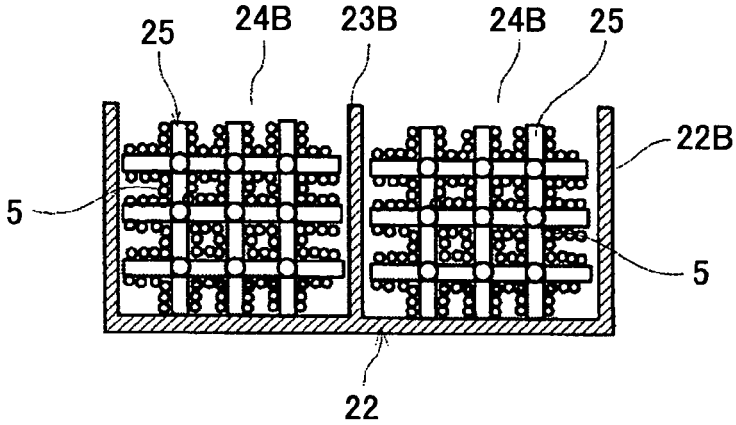
FIG. 16 is a cross-sectional view illustrating a main portion.

In addition, when the waste liquid storage container is embedded in the device or the portion of the housing of the device is directly used as the waste liquid storage container, the container body may have a complicated shape. A tenth embodiment of the waste liquid storage container according to the present invention in such a case is described with reference to FIGS. 15 and 16. FIG. 15 is a perspective view showing a waste liquid storage unit (waste liquid storage container) according to the present embodiment. FIG. 16 is a cross-sectional view illustrating a main portion according to the present embodiment.

A waste liquid storage container 21 includes a deep portion 22B relatively deeper in comparison with other portion (shallow portion 22A) in a portion of a container body 22 and a top of the deep portion 22B is open. The shallow portion 22A is divided into plural segments 24A by a rib 23A and the height of the rib 23A is lower than the height of the outer wall portion (structure of the seventh embodiment mentioned above). The deep portion 22B is divided into plural segments 24B by a rib 23B and a perforation 26*b* used as a communication portion is formed between the adjacent segment 24B and the segment 24A in the deep portion 22B and the shallow portion 22A.

Figure 17:
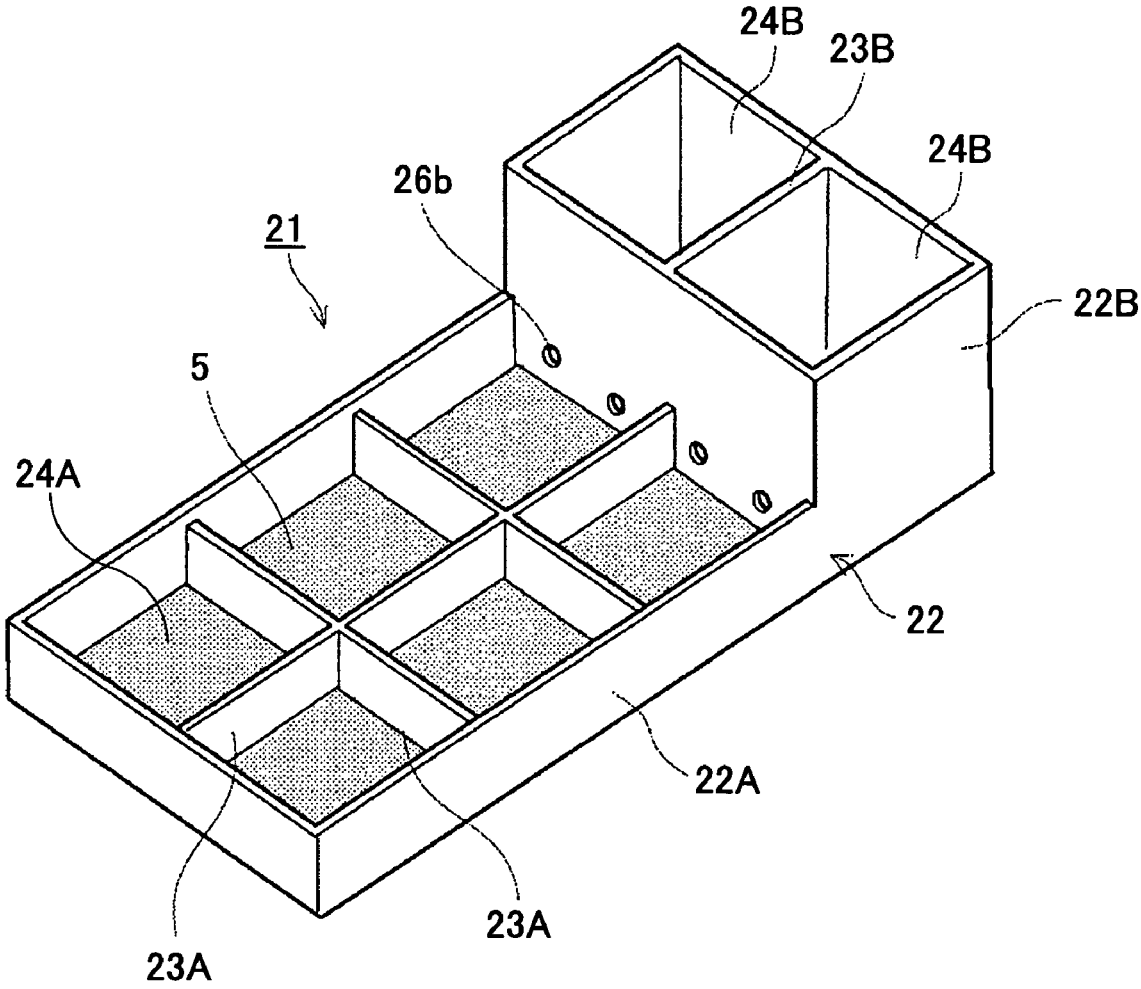
FIG. 17 is a perspective view used for illustrating a comparative example.

When the deep portion 22B is disposed as in this case, if the waste liquid absorption member 5 is merely disposed in each segment 24A as shown in FIG. 17, an absorption limit is achieved when a level of liquid reaches an upper limit of the segment 24A of the shallow portion 22A in the waste liquid storage container 21, so that the segment 24B of the deep portion 22B is not effectively used.

In view of this, in this waste liquid storage container 21, a frame member 25 is disposed in the segment 24B of the deep portion 22B, the frame member 25 having the waste liquid absorption member 5 made of high water-absorbing polymers (or high oil-absorbing polymers) adhered to a surface thereof. In accordance with this, it is possible to increase the amount of waste liquid that can be collected such that the waste liquid is also stored in an upper space (above the height of the segment 24A of the shallow portion 22A) of the segment 24B of the deep portion 22B. In addition, as described in the above-mentioned embodiment, it is effective to bond the waste liquid absorption member 5 to the inner wall surface of the segment 24B of the deep portion 22B so as to increase the amount of waste liquid that can be collected.

When the waste liquid is poured into the segment 24B of the deep portion 22B in the waste liquid storage container 21, the waste liquid is absorbed in the waste liquid absorption member 5 in the segment 24B and the waste liquid is absorbed in the waste liquid absorption member 5 of the frame member 25 as mentioned above. In addition, the waste liquid is moved to the segment 24A of the adjacent shallow portion 22A from the perforation 26*b* and the waste liquid is also absorbed in the waste liquid absorption member 5 of the segment 24A.

In this manner, it is possible to absorb the waste liquid by effectively filling a large space with the frame member 25 in which high water-absorbing polymers or high oil-absorbing polymers are disposed on the surface. Thus, even when density of the rib 23B is small, it is possible to effectively use the space as a waste liquid absorption area and increase the amount of waste liquid that can be absorbed.

In the present invention, although the rib is formed and has a complicated shape, by disposing high water-absorbing polymers or high oil-absorbing polymers having a powder shape, granular shape, flake shape, fibrous shape, gel shape, or fragment shape on a field divided (including a case where the field is not completely divided) by the rib, it is possible to use the portion for waste liquid absorption and to readily construct a portion of the device as a waste liquid storage container (area). In accordance with this, limitation on design of the waste liquid storage unit as conventionally existed is reduced and it is possible to enlarge a waste liquid absorption filed and prolong a life of the device which expires due to fill-up of waste liquid.

Figure 18:
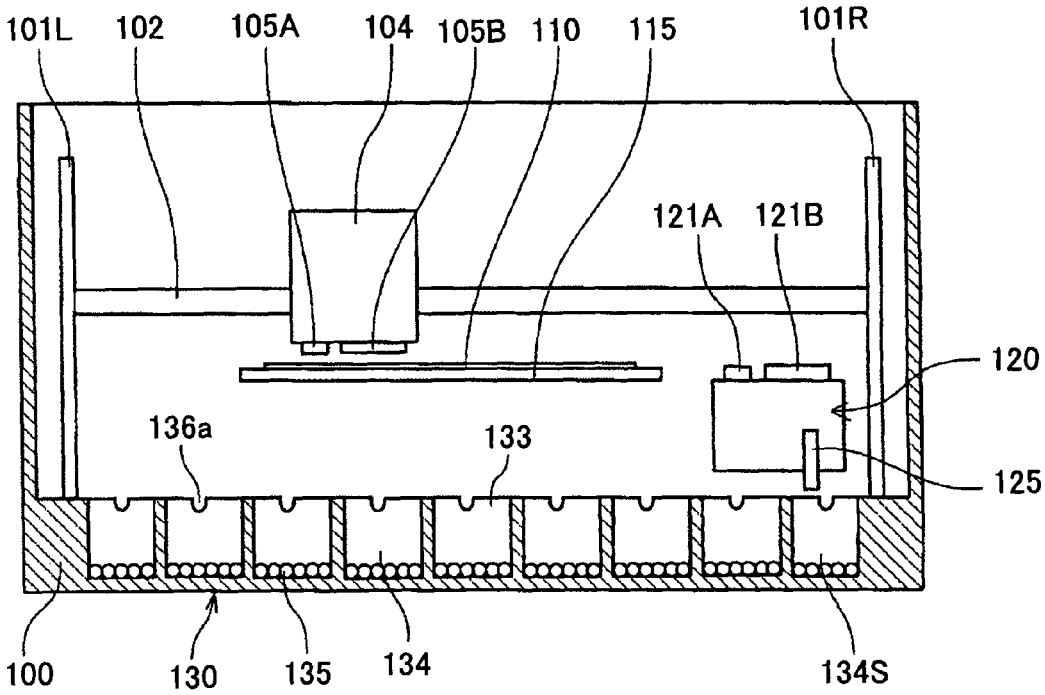
FIG. 18 is a schematic diagram showing a mechanism unit of a first embodiment of an image formation apparatus according to the present invention including a liquid discharge head according to the present invention.
Figure 19:
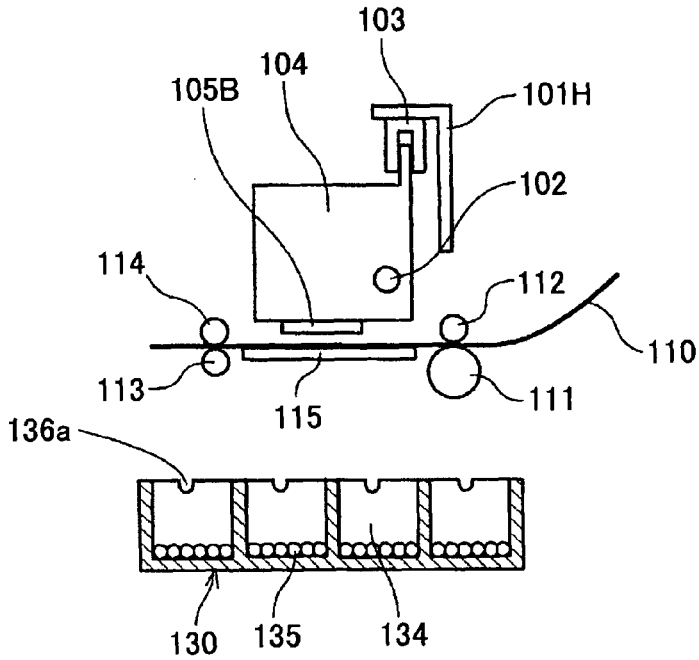
FIG. 19 is a diagram illustrating a right side of FIG. 18.
Figure 20:
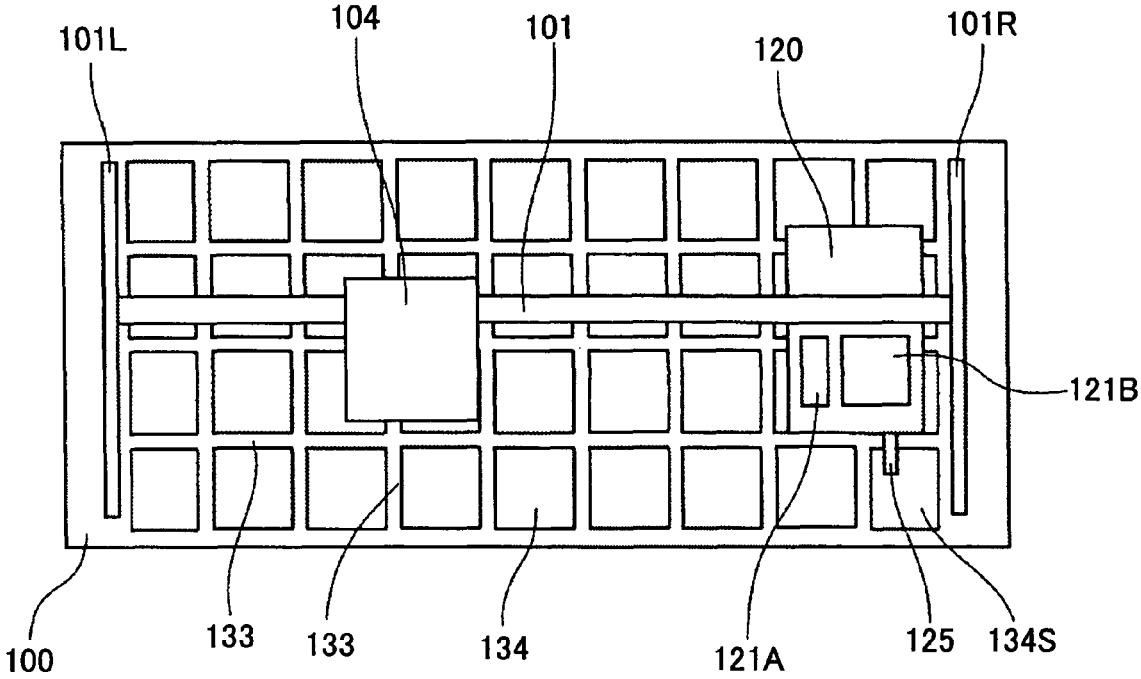
FIG. 20 is a plan view illustrating FIG. 19.

Next, a first embodiment of an image formation apparatus according to the present invention including a liquid discharge head according to the present invention is described with reference to FIGS. 18 to 20. FIG. 18 is a schematic diagram showing a mechanism unit of the image formation apparatus. FIG. 19 is a diagram illustrating a right side of FIG. 18. FIG. 20 is a plan view illustrating FIG. 19.

The image formation apparatus has a printer structure in which a carriage 104 is slidably held by a guide rod 102 laterally placed as a guide member between right and left side plates 101R and 101L disposed in a device housing 100 and by a guide rail 103 installed on a back plate 101H in a main scanning direction (longitudinal direction of the guide rod) and the carriage 104 is moved for scanning by a main scanning driving mechanism such as a main scanning motor, a timing belt, and the like not shown in the drawings in the longitudinal direction (main scanning direction) of the guide rod 102.

On the carriage 104, for example, there are disposed a black head 105A for discharging black (K) droplets and a color head 105B having a nozzle array (nozzles are arranged) for discharging each of yellow (Y), cyan (C), and magenta (M) droplets. Plural discharge outlets are arranged in a direction orthogonal relative to the main scanning direction and installed such that a direction for discharging droplets is directed downward. Further, on the carriage 104, there is installed a recording fluid cartridge (not shown in the drawings) for supplying recording fluid (ink) of each color to these recording heads 105A and 105B.

Examples of a liquid discharge head constituting the heads 105A and 105B (referred to as a "recording head 105" when no distinction is made and other members are handled in the same manner) include a piezo type, in which a piezoelectric element is used as a pressure generation unit (actuator unit) pressurizing recording fluid in a flow passage (pressure generation chamber), a vibration plate forming a wall surface of the flow passage is deformed, and a volume of the flow passage is changed, thereby discharging droplets. The examples of a liquid discharge head further include a thermal type, in which a heat element is used so as to heat recording fluid in the flow passage and generate air bubbles, thereby discharging the droplets using pressure resulting therefrom. The examples of a liquid discharge head further include an electrostatic type, in which the vibration plate forming the wall surface of the flow passage and an electrode are disposed in an opposing manner, the vibration plate is deformed using electrostatic force generated between the vibration plate and the electrode, and the volume of the flow passage is changed, thereby discharging the droplets. In the embodiment, the thermal type head is used.

Figure 24:
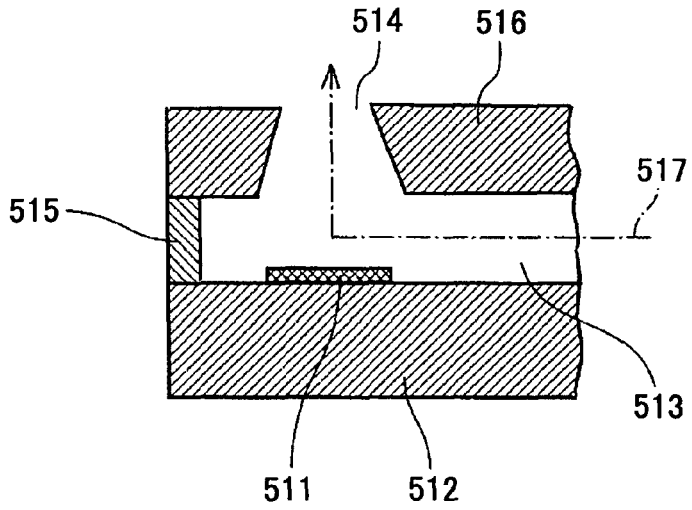
FIG. 24 is a cross-sectional view illustrating a main portion as an example of a recording head.

The thermal type head is constructed by laminating a flow passage formation member 515 for constituting a side wall of a flow passage 513 on a substrate 512 having a discharge energy generator 511 and laminating a nozzle plate 516 in which a nozzle 514 is formed on the flow passage formation member 515 as shown in FIG. 24, for example. In this head, as shown in a dashed line 517, a flow direction of recording fluid to the discharge energy acting portion in the flow passage 513 is orthogonal relative to a central axis of an opening of the nozzle 514.

On the other hand, in order to convey paper (medium) 110 below the carriage 104 in a direction orthogonal relative to the main scanning direction, a convey roller 111 and a pressure runner 112 are disposed upstream relative to the paper conveying direction, paper ejection runners (one is a runner and the other is a pulley) 113 and 114 are disposed downstream, and a printing guide member 115 is disposed opposite to the carriage 104, the printing guide member 115 guiding the paper 110.

Figure 22:
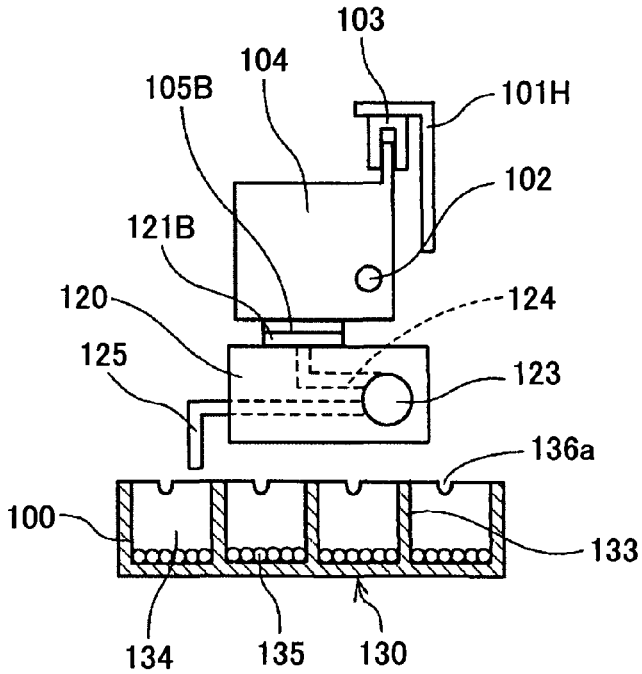
FIG. 22 is a diagram illustrating a right side of FIG. 21.

Moreover, a maintenance and recovery mechanism 120 is disposed in a non-printing area in the main scanning direction of the carriage 104, the maintenance and recovery mechanism 120 maintaining and recovering performance of the recording heads 105A and 105B. With reference to FIG. 22, the maintenance and recovery mechanism 120 includes cap members 121A and 121B for capping each nozzle surface of the recording heads 105A and 105B, a suction pump 123 connected to the cap members 121A and 121B via a tube 124, the suction pump 123 performing suction while the nozzle surface is capped, a blade member (not shown in the drawings) for wiping the nozzle surface, an empty discharge receiver (not shown in the drawings) for receiving droplets upon performing empty discharge, in which droplets that do not contribute to recording are discharged so as to eject thickened waste liquid, a driving unit (not shown in the drawings) raising and lowering the suction pump 123 and the cap members 121A and 121B, and the like. The recording fluid that has experienced suction using the suction pump 123 is ejected via a waste liquid tube 125

A bottom of the device housing 100 of the image formation apparatus is divided into multiple segments 134 by a rib 133. In an upper portion of the rib 133, a communication portion including a notch portion 136*a* is formed and high water-absorbing polymers are disposed as a waste liquid absorption member 135 in each of the segments 134. In other words, the bottom of the device housing 100 is constructed as a waste liquid storage container (waste liquid storage unit 130). In this case, acrylate resin powder having an average particle size of 300 μm is used as the high water-absorbing polymers.

Then, the above-mentioned waste liquid tube 125 of the maintenance and recovery mechanism 120 has an outlet facing the segment 134 (134S) positioned at a corner of the device housing 100 among the segments 134 formed in the device housing 100.

Figure 21:
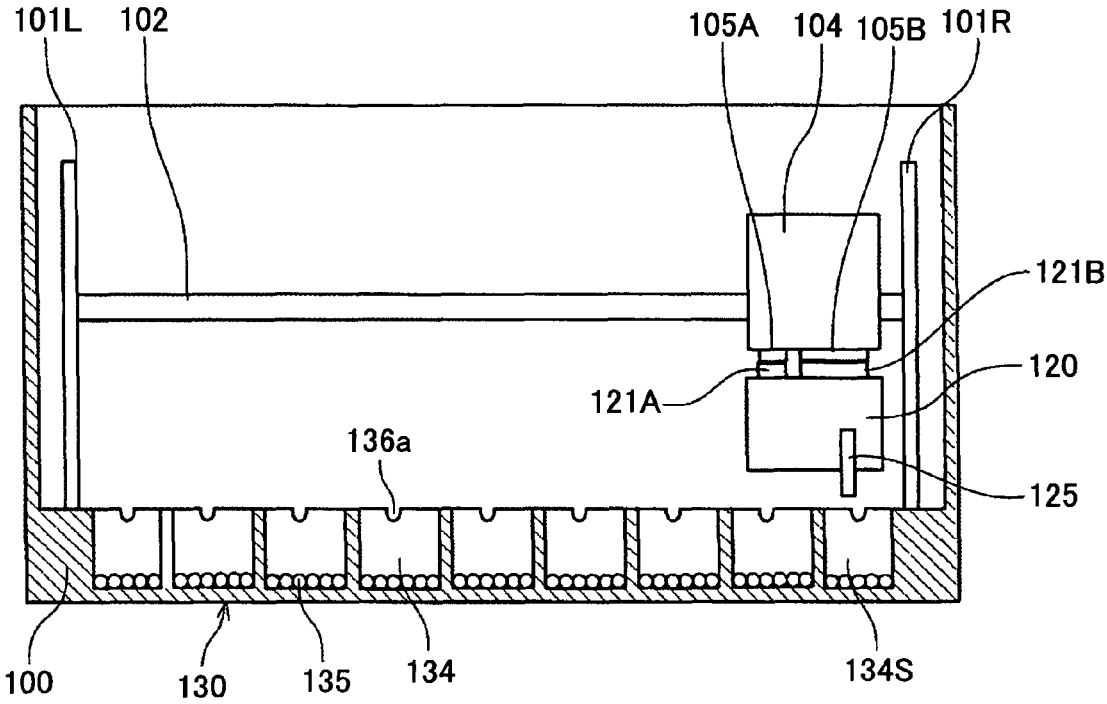
FIG. 21 is a schematic diagram showing a mechanism unit used for illustrating effects of the embodiment.
Figure 23:
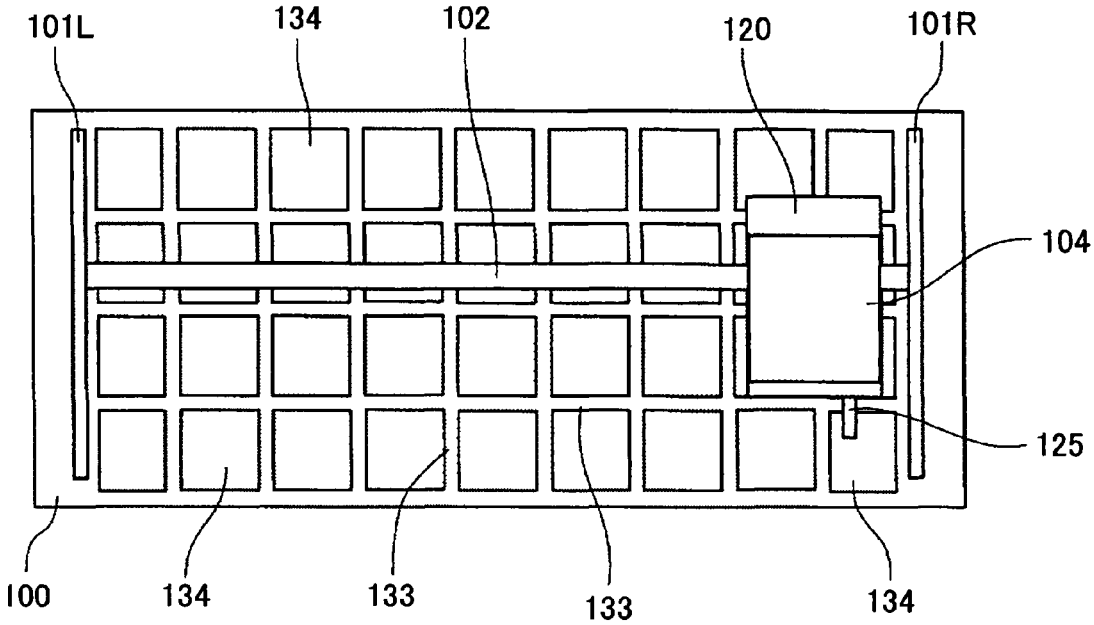
FIG. 23 is a plan view illustrating FIG. 21.

Effects of the image formation apparatus constructed in this manner are described with reference to FIGS. 21 to 23.

When an operation for maintaining and recovering the recording head 105 is performed, the carriage 104 is moved to the maintenance and recovery mechanism 120, the cap members 121A and 121B are raised so as to cap the recording heads 105A and 105B, respectively, the suction pump 123 is driven so as to form negative pressure inside the cap members 121A and 121B, and a nozzle suction (head suction) operation is performed so that recoding fluid experiences suction from the nozzles of the recording heads 105A and 105B.

In this case, the recording fluid that has experienced suction is handled as waste liquid and is dropped via the waste liquid tube 125 to the segment 134 of the waste liquid storage unit (waste liquid storage container) 130 constructed on the bottom of the device housing 100. In accordance with this, the dropped waste liquid is absorbed in the waste liquid absorption member 135 of the relevant segment 134S (where the waste liquid is dropped), a volume of the waste liquid absorption member 135 of the segment 134S is expanded, the waste liquid exceeding an amount of absorption in the waste liquid absorption member 135 is flown into the adjacent segment 134 via the notch portion 136*a*, and the flown waste liquid is absorbed in the waste liquid absorption member 135 of the segments 134 into which the waste liquid is flown. These operations are performed in a successive manner.

In this manner, the bottom of the device housing is divided into plural segments 134 by the rib 133 (partition portion), the waste liquid absorption member 135 such as high water-absorbing polymers having a powder shape is disposed in each segment 134, and the waste liquid is absorbed from the maintenance and recovery mechanism 120. Thus, it is possible to maintain strength of the bottom of the housing the rib 133 and to readily absorb the waste liquid without using a waste liquid absorber having a complicated shape in accordance with a rib shape.

In this case, if the height of the rib 133 separating each segment 134 is low, the waste liquid absorption member 135 may be moved to other segment 134 across the rib 133 and distribution may become uneven when the image formation apparatus per se is greatly tilted. In view of this, preferably, paste is sprayed on the bottom of the segment 134 and the waste liquid absorption member 135 is simply fixed. By constructing the waste liquid storage container in this manner, even when the image formation apparatus per se is greatly tilted, it is possible to prevent the waste liquid absorption member 135 from moving to other segment 134 across the rib 133. Thus, distribution of the waste liquid absorption member 135 becomes even and preferable performance is provided.

In this manner, according to the image formation apparatus including the waste liquid storage container of the present invention, it is possible to efficiently hold the waste recording fluid in the waste liquid absorption member made of high water-absorbing polymers or high oil-absorbing polymers, eliminate flowability, and prevent the waste recording fluid from being spilled out of the waste liquid storage container. Thus, handling of the waste recording fluid becomes facilitated.

Further, it is possible to secure rigidity of the container using the rib and to prevent failure of absorption of waste recording fluid resulting from unevenness of distribution of the high water-absorbing polymers or high oil-absorbing polymers initially set. By constructing the high water-absorbing polymers or high oil-absorbing polymers to have a powder shape, granular shape, flake shape, fibrous shape, gel shape, or fragment shape, it is possible to readily apply such polymers to waste liquid storage containers of any complicated shape.

Moreover, it is possible to use a portion of the device housing as a waste liquid storage unit (container), reduce limitation on design, enlarge a waste recording fluid storage area, enlarge a waste recording fluid storage area, and prolong a life of the device which expires due to fill-up of waste liquid while effectively using a space inside the device.

In the following, ink used as recording fluid in the image formation apparatus is described. Both pigment and dye may be used as a coloring material used in the image formation apparatus and the pigment and dye may be used in combination.

(Pigment)

The following substances are preferably used as pigment. Plural types of these substances may be used in combination.

Examples of organic pigments include azo pigments, phthalocyanine pigments, anthraquinone pigments, quinacridone pigments, dioxazine pigments, indigo pigments, thioindigo pigments, perylene pigments, isoindolinone pigments, aniline black pigments, azomethine pigments, rhodamine B lake pigments, carbon black pigments, and the like.

Examples of inorganic pigments include iron oxide, titanium oxide, calcium carbonate, barium sulfate, aluminum hydroxide, barium yellow, iron blue, cadmium red, chrome yellow, metallic powder, and the like.

A particle size of these pigments preferably ranges from 0.01 to 0.30 μm. If the particle size is not more than 0.01 μm, the particle size is close to that of a dye, so that light resistance and feathering are deteriorated. Also, if the particle size is not less than 0.30 μm, clogging in ejection outlets and in a filter of the printer is generated, so that ejection stability is not obtained.

Examples of carbon black used for black pigment ink include carbon black manufactured by a furnace method or a channel method, in which a size of primary particles preferably ranges from 15 to 40 millimicrons, a specific surface by a BET method ranges from 50 to 300 square meter/g, DBP oil absorption ranges from 40 to 150 ml/100 g, volatile portions range from 0.5 to 10%, and a pH value ranges from 2 to 9. Examples of such carbon black include: No. 2300, No. 900, MCF-88, No. 33, No. 40, No. 45, No. 52, MA7, MA8, MA100, No. 2200B (manufactured by Mitsubishi Chemical Co.); Raven 700, Raven 5750, Raven 5250, Raven 5000, Raven 3500, and Raven 1255 (manufactured by Columbian Carbon Co.); Regal 400R, Regal 330R, Regal 660R, Mogul L, Monarch 700, Monarch 800, Monarch 880, Monarch 900, Monarch 1000, Monarch 1100, Monarch 1300, Monarch 1400 (manufactured by Cabot Co.); and Color Black FW1, Color Black FW2, Color Black FW2V, Color Black FW18, Color Black FW200, Color Black S150, Color Black S160, Color Black S170, Printex 35, Printex U, Printex V, Printex 140U, Printex 140V, Special Black 6, Special Black 5, Special Black 4A, and Special Black 4, (manufactured by Degussa AG.), and the like. However, black carbon is not limited to these specifically disclosed materials.

Specific examples of color pigment are described in the following.

Examples of organic pigments include azo pigments, phthalocyanine pigments, anthraquinone pigments, quinacridone pigments, dioxazine pigments, indigo pigments, thioindigo pigments, perylene pigments, isoindolinone pigments, aniline black pigments, azomethine pigments, rhodamine B lake pigments, carbon black pigments, and the like. Examples of inorganic pigments include iron oxide, titanium oxide, calcium carbonate, barium sulfate, aluminum hydroxide, barium yellow, iron blue, cadmium red, chrome yellow, metallic powder, and the like.

Specific examples in each color are described in the following.

Examples of pigment used for yellow ink include C.I. Pigment Yellow 1, C.I. Pigment Yellow 2, C.I. Pigment Yellow 3, C.I. Pigment Yellow 12, C.I. Pigment Yellow 13, C.I. Pigment Yellow 14, C.I. Pigment Yellow 16, C.I. Pigment Yellow 17, C.I. Pigment Yellow 73, C.I. Pigment Yellow 74, C.I. Pigment Yellow 75, C.I. Pigment Yellow 83, C.I. Pigment Yellow 95, C.I. Pigment Yellow 97, C.I. Pigment Yellow 98, C.I. Pigment Yellow 114, C.I. Pigment Yellow 128, C.I. Pigment Yellow 129, C.I. Pigment Yellow 151, C.I. Pigment Yellow 154, and the like. However, pigment used for yellow ink is not limited to these specifically disclosed materials.

Examples of pigment used for magenta ink include C.I. Pigment Red 5, C.I. Pigment Red 7, C.I. Pigment Red 48 (Ca), C.I. Pigment Red 48 (Mn), C.I. Pigment Red 57 (Ca), C.I. Pigment Red 57:1, C.I. Pigment Red 112, C.I. Pigment Red 123, C.I. Pigment Red 168, C.I. Pigment Red 184, C.I. Pigment Red 202, and the like. However, pigment used for magenta ink is not limited to these specifically disclosed materials.

Examples of pigment used for cyan ink include C.I. Pigment Blue 1, C.I. Pigment Blue 2, C.I. Pigment Blue 3, C.I. Pigment Blue 15:3, C.I. Pigment Blue 15:34, C.I. Pigment Blue 16, C.I. Pigment Blue 22, C.I. Pigment Blue 60, C.I. Vat Blue 4, C.I. Vat Blue 60, and the like. However, pigment used for cyan ink is not limited to these specifically disclosed materials.

Further, pigment included in each ink used in the present invention may be newly manufactured for the present invention.

The above-mentioned pigments can be used as an ink-jet recording fluid by dispersing in an aqueous medium using a polymer dispersing agent or a surface active agent. Examples of such a dispersing agent include normal water soluble resin and water-soluble surface active agent.

Specific examples of water-soluble resin include block copolymers or random copolymers made from at least two of styrene, styrene derivatives, vinylnaphthalene derivatives, aliphatic alcoholic esters of $\alpha,\beta$-ethylene unsaturated carboxylic acids, acrylic acids, acrylic acid derivatives, maleic acids, maleic acid derivatives, itaconic acids, itaconic acid derivatives, fumaric acids, fumaric acid derivatives, and the like, and salts thereof.

These water-soluble resins are alkali-soluble resin which is soluble in a solution in which bases are dissolved. Those resins with a weight average molecular weight ranging from 3000 to 20000 are especially preferable in that the resins are capable of making a dispersion liquid have a low viscosity and easy dispersion when used for recording fluids for ink-jet printing.

It is preferable to use a polymer dispersing agent and a self-dispersing pigment at the same time, since a moderate dot size is obtained. Although a mechanism thereof is less obvious, the following reasons are considered.

By containing the polymer dispersing agent, permeation into recording paper is controlled. On the other hand, by containing the polymer dispersing agent, coagulation of the self-dispersing pigment is reduced, so that the self-dispersing pigment is capable of smoothly spreading in a lateral direction. In accordance with this, dots are spread in a wide and thin manner and ideal dots can be formed.

Specific examples of water-soluble surface active agent that can be used as a dispersing agent include the following materials. Examples of anionic surface active agent include higher fatty acid salt, alkylsulfuric acid salt, alkyl ether sulfate, alkyl ester sulfate, alkyl aryl ether sulfate, alkyl sulfonate, sulfosuccinate, alkyl aryl and alkylnaphthalene sulfonate, alkyl phosphate, polyoxyethylene alkyl ether phosphate ester, alkyl aryl ether phosphate, and the like. Examples of cationic surface active agent include salts, dialkylamine salts, tetra-alkylammonium salts, benzalkonium salts, alkylpyridinium salts, imidazolinium salts, and the like.

Examples of ampholytic surface active agent include dimethyl alkyl lauryl betaine, alkyl glycine, alkyl (diaminoethyl) glycin, imidazolinium betaine, and the like. Examples of nonionic surface active agent include polyoxyethylene alkyl ether, polyoxyethylene alkyl allyl ether, polyoxyethylene polyoxypropylene glycol, glycerin ester, sorbitan ester, sucrose ester, polyoxyethylene ether of glycerin ester, polyoxyethylene ether of sorbitan ester, polyoxyethylene ether of sorbitol ester, fatty acid alkanolamide, polyoxyethylene fatty acid amide, amine oxide, polyoxyethylene alkylamine, and the like.

Pigments may be microencapsulated by coating with resin having a hydrophilic group so as to provide dispersibility.

As a method for microencapsulating water-insoluble pigment by coating with organic polymers, any known methods may be used. Examples of known methods include chemical manufacturing methods, physical manufacturing methods, physicochemical methods, mechanical manufacturing methods, and the like. Specifically, examples of such methods include interfacial polymerization methods, in-situ polymerization methods, in-liquid cure coating methods, coacervation (phase separation) methods, in-liquid drying methods, fusion dispersion cooling methods, air suspension coating methods, spray drying methods, acid separation methods, phase inversion emulsification methods, and the like.

The interfacial polymerization methods refer to methods of forming a wall film in which two types of monomers or two types of reactants are separately dissolved in a dispersed phase and a continuous phase and then the wall film is formed by reacting both materials at a phase boundary thereof. The in-situ polymerization methods refer to methods of forming a wall film in which two types of materials, namely, a liquid or gaseous monomers and a catalyst or a reactive material are supplied from one side of nuclear particles of continuous phase so as to cause a reaction, thereby forming a wall film. The in-liquid cure coating methods refer to methods of forming a wall film in which droplets of a polymer solution containing core material particles are insolubilized in the liquid using a curing agent or the like, thereby forming a wall film.

Coacervation (phase separation) methods refer to methods of forming a wall film in which a polymer-dispersed liquid containing core material particles dispersed therein is separated into a coacervate with a high concentration of polymers (dense phase) and a sparse phase, and a wall film is formed. The in-liquid drying methods refer to methods of forming a wall film in which a liquid containing core materials in a solution of wall film materials is prepared and a dispersion liquid is supplied to the liquid where a continuous phase of the dispersion liquid is not miscible so as to have a complex emulsion, and then a wall film is formed by gradually removing medium into which the wall film materials are dissolved.

The fusion dispersion cooling methods refer to methods of forming a wall film, in which wall film materials which are fused upon heating and are solidified at normal temperature are used. The materials are heated to be a liquid and core material particles are dispersed thereinto. The core material particles are made to be fine particles and cooled, thereby forming a wall film. The air suspension coating methods refer to methods of forming a wall film in which core material particles in a powder form are suspended in the air using a fluidized bed and a coating liquid is sprayed and mixed with the core material particles floating in an airflow, and then a wall film is formed.

The spray drying methods refer to methods of forming a wall film in which an undiluted encapsulating solution is sprayed and brought into contact with a heated air and a wall film is formed by allowing a volatile component to be evaporated and dried. In the acid separation methods, at least a portion of anionic groups of organic polymer compounds containing the anionic groups is neutralized using basic compounds. In accordance with this, solubility to water is provided and the solubility-provided anionic groups are mixed with a coloring material in an aqueous medium. Then, the resultant substance is made neutral or acidic using acidic compounds, organic compounds are separated and bonded to the coloring material, and then the substance is neutralized and dispersed. In the phase inversion emulsification methods, a mixture containing anionic organic polymers having a dispersion potential relative to water and a coloring material is used as an organic solvent phase. Water is provided to the organic solvent phase or the organic solvent phase is provided to water.

Examples of organic polymers (resins) used as materials constituting wall film materials of microcapsules include polyamides, polyurethane, polyester, polyurea, epoxy resin, polycarbonate, urea resin, melamine resin, phenolic resin, polysaccharides, gelatin, gum arabic, dextran, casein, proteins, natural rubber, carboxypolymethylene, polyvinyl alcohol, polyvinyl pyrrolidone, polyvinyl acetate, polyvinyl chloride, polyvinylidene chloride, cellulose, ethyl cellulose, methyl cellulose, nitrocellulose, hydroxyethyl cellulose, cellulose acetate, polyethylene, polystyrene, (metha) acrylic acid polymers or copolymers, (metha) acrylic ester polymers or copolymers, (metha) acrylic acid-(metha) acrylic ester copolymers, styrene-(metha) acrylic copolymers, styrene-maleic acid copolymers, alginic acid soda, fatty acids, paraffin, beeswax, aqueous wax, solid beef tallow, carnauba wax, albumin, and the like.

From the above-mentioned materials, it is possible to use organic polymers having anionic groups such as carboxylic groups or sulfonic groups. Also, Examples of nonionic organic polymers include polyvinyl alcohol, polyethylene glycol monomethacrylate, polypropylene glycol monomethacrylate, methoxypolyethylene glycol monomethacrylate, or (co)polymers thereof, cationic ring-opening copolymers of 2-oxazoline, and the like. In particular, completely saponified polyvinyl alcohol is particularly preferable in that it has low water solubility and that it is soluble in hot water but less soluble in cold water.

Further, an amount of the organic polymers constituting the wall film materials of microcapsules ranges from not less than 1% by weight to not more than 20% by weight relative to a water-insoluble coloring material such as organic pigments, carbon black, or the like. By maintaining the amount of the organic polymers within the above-mentioned range, a percentage of content of the organic polymers in the capsules is made to be relatively low, so that it is possible to control reduction of color development of pigments resulting from the fact that surfaces of pigment are covered with the organic polymers. If the amount of the organic polymers is less than 1% by weight, the effect of encapsulation is unlikely to be obtained. By contrast, if the amount exceeds 20% by weight, the reduction of color development of pigments becomes large. Taking into consideration other characteristics in addition to the above-mentioned fact, the amount of organic polymers preferably ranges from 5% to 10% by weight relative to a water-insoluble coloring material.

In other words, a portion of the coloring material is practically uncoated and exposed, so that it is possible to control the reduction of color development of pigments. Further, by contrast, since a portion of the coloring material is practically coated and unexposed, it is also possible to have an effect such that the pigments are partially coated at the same time. Moreover, a number average molecular weight of organic polymers is preferably not less than 2000 in terms of a capsule manufacturing process and the like. In this case, the term "practically exposed" does not refer to a partial exposure from pinholes or cracking accompanied by defects, but means an intentional exposure.

Further, if an organic pigment such as a self-dispersing pigment or self-dispersing carbon black is used as a coloring material, dispersibility of the pigment is improved even when the percentage of content of the organic polymers in the capsules is low. This is more preferable in the present invention since sufficient preservation stability for ink is obtained.

In addition, depending on methods of microencapsulation, it is preferable to select organic copolymers suitable thereto. For example, in the case of the interfacial polymerization method, examples of suitable organic polymers include polyester, polyamide, polyurethane, polyvinyl pyrrolidone, epoxy resin, and the like. In the case of the in-situ polymerization method, examples of suitable organic polymers include (metha) acrylic ester polymers or copolymers, (metha) acrylic acid-(metha) acrylic ester copolymers, styrene-(metha) acrylic copolymers, polyvinyl chloride, polyvinylidene chloride, polyamide, and the like. In the case of the in-liquid cure coating method, examples of suitable organic polymers include alginic acid soda, polyvinyl alcohol, gelatin, albumin, epoxy resin, and the like. In the case of the coacervation method, examples of suitable organic polymers include gelatin, celluloses, casein, and the like. Further, in order to obtain fine and homogeneous microencapsulated pigments, any known encapsulation methods may be used in addition to the above-mentioned methods.

If the phase inversion or acid separation method is selected as a microencapsulation method, anionic organic polymers are used as organic polymers constituting wall film materials of microcapsules. In the phase inversion method, a compound or complex of anionic organic polymers having a self-dispersion potential or solubility potential relative to water and a coloring material such as self-dispersive organic pigment, self-dispersive carbon black, or the like is used as an organic solvent phase. Or a mixture of a coloring material such as a self-dispersive organic pigment or self-dispersive carbon black or a curing agent and anion organic polymers is used as an organic solvent phase. By providing water to the organic solvent phase or providing the organic solvent phase to water, microencapsulation is performed during self-dispersion (phase inversion emulsification). In the above phase inversion method, vehicles for a recording fluid and additives may be mixed into the organic solvent phase during manufacturing process thereof. In particular, taking into consideration the fact that a dispersion liquid for the recording fluid is directly manufactured, it is more preferable to mix liquid media of the recording fluid.

By contrast, in the acid separation method, at least a portion or an entire portion of anionic groups of organic polymers containing the anionic groups is neutralized using basic compounds. And, the anionic groups are mixed with a coloring material such as a self-dispersive organic pigment or self-dispersive carbon black in an aqueous medium. Then, pH of the resultant substance is made neutral or acidic using acidic compounds, organic polymers containing the anionic groups are separated and bonded to the coloring material, thereby obtaining a hydrated cake. The cake is microencapsulated by neutralizing a portion or an entire portion of anionic groups using basic compounds. In this manner, it is possible to manufacture an aqueous dispersion liquid containing fine anionic microencapsulated pigment having much pigment.

Further, examples of solvent used upon microencapsulation as mentioned above include: alkyl alcohols such as methanol, ethanol, propanol, butanol and the like; aromatic hydrocarbons such as benzole, toluole, xylole, and the like; esters such as methyl acetate, ethyl acetate, butyl acetate, and the like; chlorinated hydrocarbons such as chloroform, ethylene dichloride, and the like; ketones such as acetone, methyl isobutyl ketone, and the like; ethers such as tetrahydrofuran, dioxane, and the like; and cellosolves such as methyl cellosolve, butyl cellosolve, and the like. The microcapsules manufactured in the above-mentioned manner are separated from the solvent using centrifugal separation, filtration, or the like, and the separated substance is agitated and dispersed again with water and a required solvent, thereby obtaining a recording fluid that can be used in the present invention. An average particle size of encapsulated pigment obtained from the aforementioned method preferably ranges from 50 nm to 180 nm.

It is possible to improve abrasion durability of printing by firmly attaching pigment to a printing material through resin coating in this manner.

(Dye)

Examples of dye used for recording fluid include dye classified into acid dye, direct dye, basic dye, reactive dye, edible dye, and have superior water resistance and light resistance. These types of dye may be used by mixing with plural types or mixing with other coloring material such as pigment as appropriate. These types of dye are added to the extent that effects of the present invention are not inhibited.

(a) Examples of acid dye and edible dye include:

C.I. Acid Yellow 17, 23, 42, 44, 79, 142;

C.I. Acid Red 1, 8, 13, 14, 18, 26, 27, 35, 37, 42, 52, 82, 87, 89, 92, 97, 106, 111, 114, 115, 134, 186, 249, 254, 289;

C.I. Acid Blue 9, 29, 45, 92, 249;

C.I. Acid Black 1, 2, 7, 24, 26, 94;

C.I. Food Yellow 3, 4;

C.I. Food Red 7, 9, 14; and

C.I. Food Black 1, 2.

(b) Examples of direct dye include:

C.I. Direct Yellow 1, 12, 24, 26, 33, 44, 50, 86, 120, 132, 142, 144;

C.I. Direct Red 1, 4, 9, 13, 17, 20, 28, 31, 39, 80, 81, 83, 89, 225, 227;

C.I. Direct Orange 26, 29, 62, 102;

C.I. Direct Blue 1, 2, 6, 15, 22, 25, 71, 76, 79, 86, 87, 90, 98, 163, 165, 199, 202; and C.I. Direct Black 19, 22, 32, 38, 51, 56, 71, 74, 75, 77, 154, 168, 171.

(c) Examples of basic dye include:

C.I. Basic Yellow 1, 2, 11, 13, 14, 15, 19, 21, 23, 24, 25, 28, 29, 32, 36, 40, 41, 45, 49, 51, 53, 63, 64, 65, 67, 70, 73, 77, 87, 91;

C.I. Basic Red 2, 12, 13, 14, 15, 18, 22, 23, 24, 27, 29, 35, 36, 38, 39, 46, 49, 51, 52, 54, 59, 68, 69, 70, 73, 78, 82, 102, 104, 109, 112;

C.I. Basic Blue 1, 3, 5, 7, 9, 21, 22, 26, 35, 41, 45, 47, 54, 62, 65, 66, 67, 69, 75, 77, 78, 89, 92, 93, 105, 117, 120, 122, 124, 129, 137, 141, 147, 155; and C.I. Basic Black 2, 8.

(d) Examples of reactive dye include:

C.I. Reactive Black 3, 4, 7, 11, 12, 17;

C.I. Reactive Yellow 1, 5, 11, 13, 14, 20, 21, 22, 25, 40, 47, 51, 55, 65, 67;

C.I. Reactive Red 1, 14, 17, 25, 26, 32, 37, 44, 46, 55, 60, 66, 74, 79, 96, 97; and C.I. Reactive Blue 1, 2, 7, 14, 15, 23, 32, 35, 38, 41, 63, 80, 95.

(Additive and Physical Propertied Common to Dye and Pigment)

In order to have desired recording fluid used in the image formation apparatus according to the present invention or prevent clogging of nozzles of the recording head resulting from drying, preferably, water-soluble organic solvent is used other than coloring material. Examples of the water-soluble organic solvent include wetting agent and penetrant. The wetting agent is added so as to prevent the clogging of nozzles of the recording head resulting from drying.

Specific examples of the wetting agent include polyhydric alcohols such as ethylene glycol, diethylene glycol, triethylene glycol, tetraethylene glycol, polyethylene glycol, propylene glycol, 1,3-butanediol, 1,3-propanediol, 2-methyl-1,3-propanediol, 1,4-butanediol, 1,5-pentanediol, 1,6-hexanediol, glycerin, 1,2,6-hexanetriol, 2-ethyl-1,3-hexanediol, 1,2,4-butanetriol, 1,2,3-butanetriol, petriol, polyhydric alcohol alkylethers such as ethylene glycol monoethylether, ethylene glycol monobutylether, diethylene glycol monomethylether, diethylene glycol monoethylether, diethylene glycol monobutylether, triethylene glycol monobutylether, tetraethylene glycol monomethylether, and propylene glycol monoethylether, polyhydric alcohol arylethers such as ethylene glycol monophenylether and ethylene glycol monobenzylether, nitrogen-containing heterocyclic compounds such as N-methyl-2-pyrrolidone, N-hydroxyethyl-2-pyrrolidone, 2-pyrrolidone, 1,3-dimethyl imidazolidinone, ϵ-caprolactam, amides such as formamide, N-methyl formamide, and N,N-dimethyl formamide, amines such as monoethanolamine, diethanol amine, triethanolamine, monoethyl amine, diethyl amine, and triethylamine, sulfur-containing compounds such as dimethyl solfoxde, sulforan and thiodiethanol, propylene carbonate, ethylene carbonate, γ-butyrolactone, and the like. These solvents are used with water either alone or in combination.

The penetrant is added so as improve wettability of the recording fluid and a recording subject material and adjust permeation speed. Preferably, examples of penetrant include substances expressed by the following formulas (I) to (IV). In other words, it is possible to reduce surface tension of liquid so that the wettability is improved and the permeation speed is increased by using surface active agent of polyoxyethylene alkyl phenyl ether expressed by the following formula (I), surface active agent of acetylene glycol expressed by the following formula (II), surface active agent of polyoxyethylene alkyl ether expressed by the following formula (III), and surface active agent of polyoxyethylene polyoxypropylene alkyl ether expressed by the following formula (IV).

(Chemical formula 1)

(I)

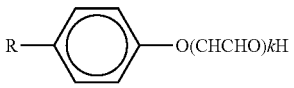

where R indicates a hydrocarbon chain whose carbon number is 6 to 14 that may be branched and k indicates 5 to 20.

(Chemical formula 2)

(II)

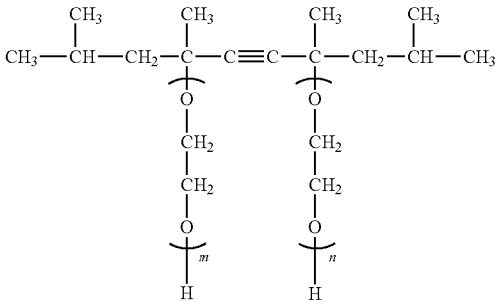

where m and n indicate 0 to 40.

(Chemical Formula 3)

$$R—(OCH_2CH_2)nH \quad (III)$$

where R indicates a hydrocarbon chain whose carbon number is 6 to 14 that may be branched and n indicates 5 to 20.

(Chemical formula 4)

(IV)

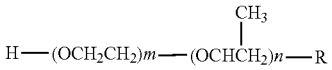

where R indicates a hydrocarbon chain whose carbon number is 6 to 14 and m and n indicate a number not more than 20.

Other than the chemical compounds expressed by the above-mentioned formulas (I) to (IV), it is possible to use polyhydric alcohol alkyl and aryl ethers such as diethylene glycol monophenyl ether, ethylene glycol monophenyl ether, ethylene glycol monoallyl ether, diethylene glycol monobutyl ether, propylene glycol monobutyl ether, tetraethylene glycol chlorophenyl ether, nonionic surface active agents such as polyoxyethylene polyoxypropylene blockcopolymer, fluorochemical surfactant, lower alcohols such as ethanol, 2-propanol, and the like. In particular, diethylene glycol monobutyl ether is preferably used.

Preferably, surface tension of recording fluid used in the image formation apparatus according to the present invention ranges from 10 to 60 N/m. Further preferably, the surface tension ranges from 15 to 30 N/m in terms of a balance between the wettability of the recording subject material and formation of droplet particles.

Preferably, viscosity of the recording fluid is within a range from 1.0 to 20 mPa·s and preferably within a range from 5.0 to 10 mPa·s in terms of ejection stability.

Preferably, pH of the recording fluid is within a range from 3 to 11. Further preferably, the pH of the recording fluid is within a range from 6 to 10 in terms of controlling corrosion of a metal member brought into contact with the fluid.

Moreover, the recording fluid may contain preservative and mildewproofing agent. By containing the preservative and mildewproofing agent, it is possible to prevent propagation of bacteria and improve stability of preservation and image quality. Examples of preservative and mildewproofing agent include benzotriazole, sodium dehydroacetate, sodium sorbate, 2-pyridinethiol-1-sodium oxide, isothiazolin compound, sodium benzoate, sodium pentachlorophenol, and the like.

Further, rustproofing agent may be contained in the recording fluid. By containing the rustproofing agent, it is possible to form coating on a metal surface such as the recording head brought into contact with the fluid and prevent corrosion. Examples of rust-proofing agent include sodium hydrogen sulfite, sodium thiosulfate, ammonium thiodiglycolic acid, diisopropylammonium nitrite, pentaerythritol tetranitrate, dicyclohexylammonium nitrite, and the like.

Moreover, antioxidant may be contained in the recording fluid. By containing the antioxidant, it is possible to prevent corrosion by eliminating radical species even when such radical species causing corrosion are generated.

Typical antioxidant is phenolic compounds and amine compounds. Examples of phenolic compounds include compounds such as hydroquinone and gallate, hindered phenol compounds such as 2,6-di-tert-butyl-p-cresol, stearyl-β-(3,5-di-tert-butyl-4-hydroxy-phenyl) propionate, 2,2'-methylenebis (4-methyl-6-tert-butylphenol), 2,2'-methylenebis (4-ethyl-6-tert-butylphenol), 4,4'-thiobis (3-methyl-6-tert-butylphenol), 1,1,3-tris (2-methyl-4-hydroxy-5-tert-butylphenyl) butane, 1,3,5-trimethyl-2,4,6-tris (3,5-di-tert-4-hydroxybenzyl) benzene, tris (3,5-di-tert-butyl-4-hydroxybenzyl) isocyanurate, tetrakis [methylene-3 (3',5'-di-tert-butyl-4'-hydroxyphenyl) propionate]methane, and the like. Examples of amine compounds include N,N'-diphenyl-p-phenylenediamine, phenyl-β-naphthylamine, phenyl-α-naphthylamine, N,N'-β-naphthyl-p-phenylenediamine, N,N'-diphenylethylenediamine, phenothiazine, N,N'-di-sec-butyl-p-phenylenediamine, 4,4'-tetramethyl-diaminodiphenylmethane, and the like. Typical secondary antioxidant is sulfuric compounds and phosphorous compounds. Examples of sulfuric compounds include dilauryl thiodipropionate, distearyl thiodipropionate, laurylstearyl thiodipropionate, dimyristyl thiodipropionate, distearyl β,β'-thiodibutyrate, 2-mercaptobenzimidazole, dilauryl sulfide, and the like. Examples of phosphorous compounds include triphenyl phosphite, trioctadecyl phosphite, tridecyl phosphite, trilauryl trithiophosphite, diphenylisodecyl phosphite, trinonylphenyl phosphite, distearyl pentaerythritol phosphite, and the like.

Moreover, pH adjuster may be contained in the recording fluid. Examples of the pH adjuster include hydroxides of alkali metal such as lithium hydroxide, sodium hydroxide, potassium hydroxide, carbonates of alkali metal such as ammonium hydroxide, quaternary ammonium hydroxide, quaternary phosphonium hydroxide, lithium carbonate, sodium carbonate, potassium carbonate, amines such as diethanolamine, and triethanolamine, boric acid, hydrochloric acid, nitric acid, sulfuric acid, acetic acid, and the like.

Figure 25:
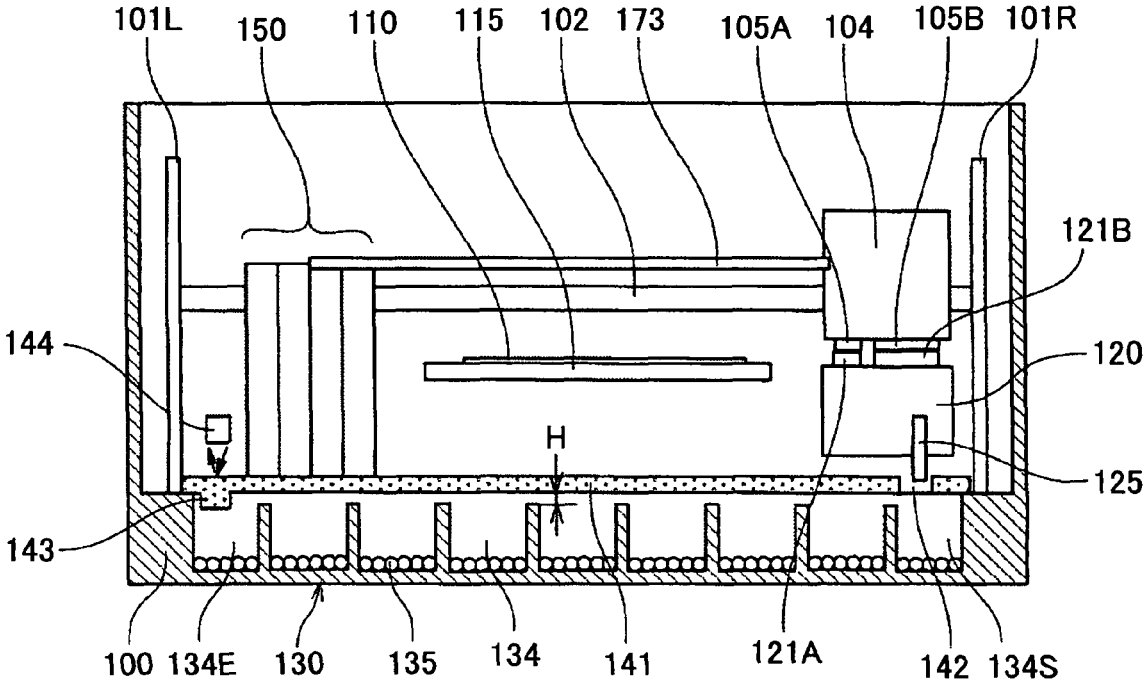
FIG. 25 is a schematic diagram showing a mechanism unit of a second embodiment of an image formation apparatus according to the present invention including a liquid discharge head according to the present invention.
Figure 26:
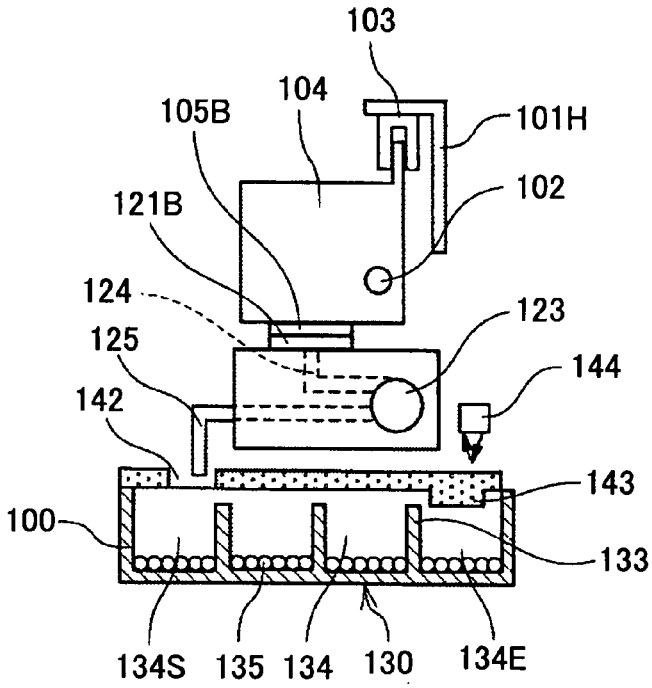
FIG. 26 is a diagram illustrating a right side of FIG. 25.
Figure 27:
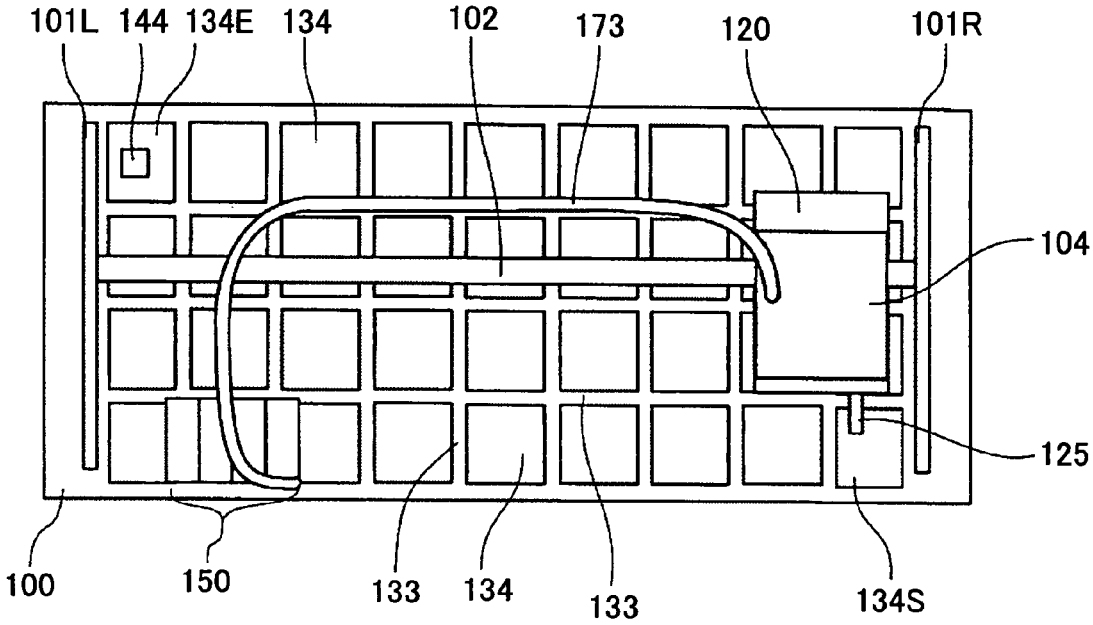
FIG. 27 is a plan view illustrating FIG. 25.

Next, a second embodiment of the image formation apparatus according to the present invention is described with reference to FIGS. 25 to 27. FIG. 25 is a schematic diagram showing a mechanism unit of the image formation apparatus, FIG. 26 is a diagram illustrating a right side of FIG. 25, and FIG. 27 is a plan view illustrating FIG. 25.

In the image formation apparatus, sub-tanks not shown in the drawings are installed on the carriage 104, the sub-tank supplying the recording fluid to the nozzle array of each color of the recording head 105A and the recording head 105B, and a recording fluid supply system is constructed such that the recording fluid is supplied from a recording fluid cartridge 150 for each color to each sub-tank via tubes 173 for each color, the recording fluid cartridge 150 being installed on a body of the apparatus in a detachable manner.

The recording fluid cartridge 150 may include an element for notifying conditions inside the recording fluid cartridge 150 by radio, namely, an element having a detection sensor detecting conditions of the recording fluid, an electric circuit converting information into radio wave signals, and a transmission unit transmitting radio waves, for example.

Further, the waste liquid storage unit 130 is formed on the bottom of the device housing 100 such that the height of the rib 133 dividing a space into plural segments is somewhat lower than the height of the outermost portion (by a distance H, refer to FIG. 25) and the waste liquid absorption member 135 having a fibrous shape and including high water-absorbing polymers is disposed inside each of the segments 134 divided by the rib 133.

Further, there is disposed a top plate 141 including melamine foam as a porous member covering a top opening of the waste liquid storage unit 130. In the top plate 141, an opening portion 142 used as a waste liquid pouring inlet is formed at a position for the waste liquid tube 125 where waste liquid is dropped and a convex portion 143 protruding to the segment (downward) is formed at a position for the segment 134 (134E) most distant from the segment 134 (134S) for the opening portion 142.

In addition, a fill-up detection sensor 144 is disposed above the top plate 141 where the convex portion 143 is formed, the fill-up detection sensor 144 being constructed using a reflective photo sensor used as a fill-up detection unit detecting fill-up by detecting a change of color of the top plate 141.

In accordance with the aforementioned structure, waste liquid generated when the nozzle suction is performed as mentioned above is dropped via the waste liquid tube 125 to the segment 134S of the waste liquid storage unit (waste liquid storage container) 130 constructed on the bottom of the device housing 100. Accordingly, the dropped waste liquid is absorbed in the waste liquid absorption member 135 of the relevant segment 134 (where the waste liquid is dropped), the volume of the waste liquid absorption member 135 of the segment 134S is expanded, the waste liquid exceeding the amount of absorption in the waste liquid absorption member 135 is flown into the adjacent segment 134 over an upper end surface of the rib 133, and the flown waste liquid is absorbed in the waste liquid absorption member 135 of the segments 134 into which the waste liquid is flown. These operations are performed in a successive manner.

When the waste liquid reaches the segment 134E and the waste liquid absorption member 5 is swelled, the waste liquid is in contact with the convex portion 143 of the top plate 141, so that a color in the vicinity of the convex portion 143 is changed to a color of the waste liquid. Accordingly, fill-up is detected by the fill-up detection sensor 144. In this case, the convex portion 143 is disposed on a detection portion of the top plate 141, so that early fill-up detection is performed when the segments 134 becomes full of waste liquid. Further, the top plate 141 including the porous body is disposed, so that the waste liquid is prevented from spilling out of the waste liquid storage container even when the waste liquid storage unit 130 is tilted to some extent.

Figure 28:
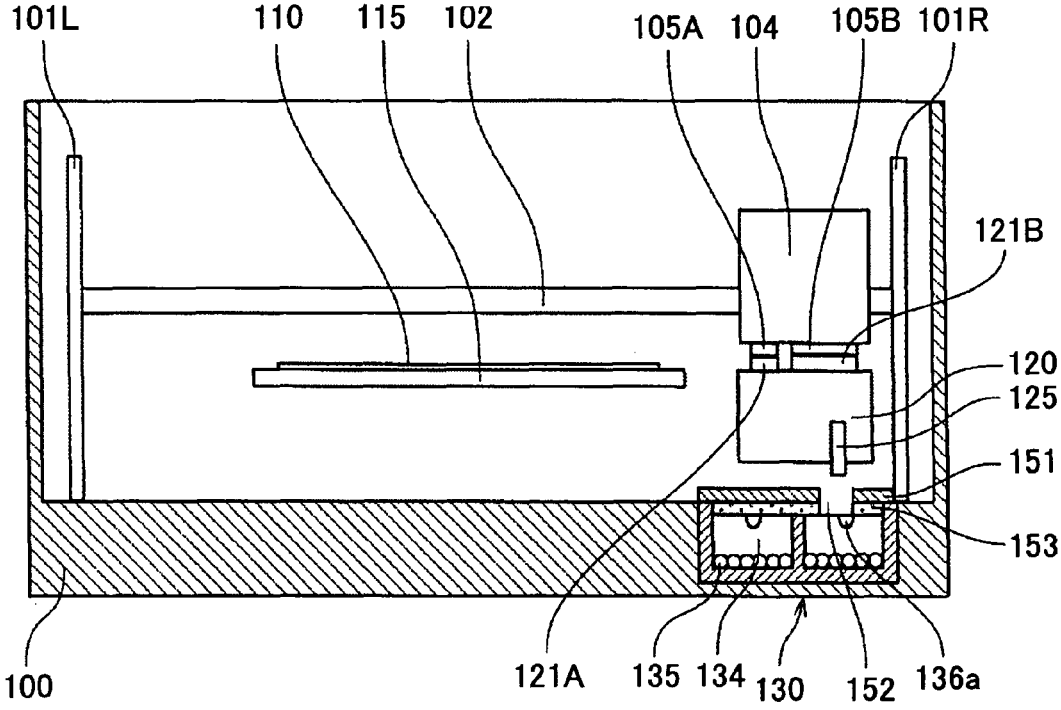
FIG. 28 is a schematic diagram showing a mechanism unit of a third embodiment of an image formation apparatus according to the present invention including a liquid discharge head according to the present invention.
Figure 29:
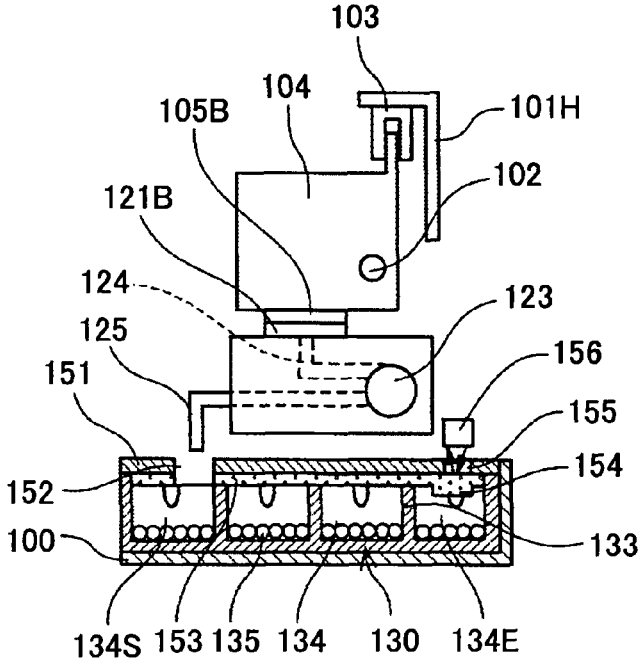
FIG. 29 is a diagram illustrating a right side of FIG. 28.
Figure 30:
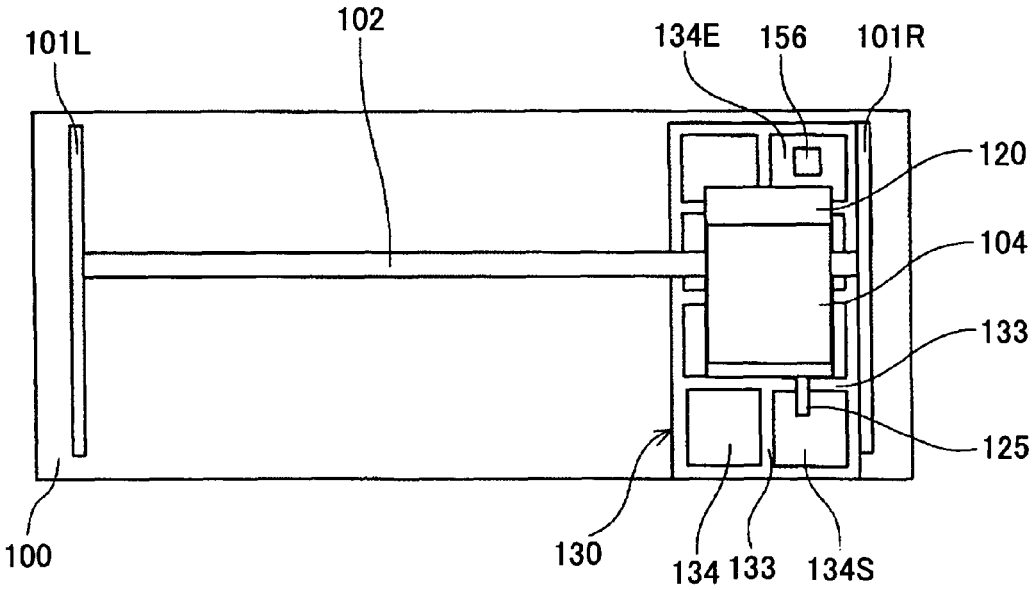
FIG. 30 is a plan view illustrating FIG. 28.

Next, a third embodiment of the image formation apparatus according to the present invention is described with reference to FIGS. 28 to 30. FIG. 28 is a schematic diagram showing a mechanism unit of the image formation apparatus. FIG. 29 is a diagram illustrating a right side of FIG. 28. And FIG. 30 is a plan view illustrating FIG. 28.

In the image formation apparatus, the waste liquid storage unit (waste liquid storage container) 130 is configured to be installed on the device housing 100 in a detachable manner. In the waste liquid storage unit 130, plural ribs 133 are formed inside a container body 132 using resin molded parts and the like so as to divide a space into plural segments 134. In the upper portion of the rib 133, the notch portion 136*a* used as a communication portion is formed. High water-absorbing polymers are disposed as the waste liquid absorption member 135 in each of the segments 134.

The waste liquid storage unit 130 has a lid member 151 disposed on an upper portion thereof and an sealed structure except for an opening portion 152 used as a waste liquid pouring inlet formed at a position for the waste liquid tube 125. Further, a top plate 153 including a porous body is disposed inside the lid member 151. In the top plate 153, a convex portion 154 protruding to the segment (downward) is formed at a position for the segment 134E most distant (separated) from the segment 134 for an opening portion (constituting a portion of the opening portion 152) formed at a position for the waste liquid tube 125 to which the waste liquid is dropped.

Moreover, in the lid member 151, an opening portion (or a transparent member) 155 is disposed at a position for the convex portion 154 of the top plate 153 and a fill-up detection sensor 156 is disposed above the opening portion 155 so as to detect fill-up by detecting a change of color of the top plate 153.

Such a waste liquid storage unit 130 is set inside the device housing 100 and waste liquid generated when the nozzle suction is performed as mentioned above is dropped via the waste liquid tube 125 to the segment 134S of the waste liquid storage unit 130. Accordingly, the dropped waste liquid is absorbed in the waste liquid absorption member 135 of the relevant segment 134S (where the waste liquid is dropped), the volume of the waste liquid absorption member 135 of the segment 134 is expanded, the waste liquid exceeding the amount of absorption in the waste liquid absorption member 135 is flown into the adjacent segment 134 over an upper end surface of the rib 133, and the flown waste liquid is absorbed in the waste liquid absorption member 135 of the segments 134 into which the waste liquid is flown. These operations are performed in a successive manner.

When the waste liquid reaches the segment 134E and the waste liquid absorption member 5 is swelled, the waste liquid is in contact with the convex portion 154 of the top plate 153, so that a color in the vicinity of the convex portion 154 is changed to a color of the waste liquid. Accordingly, fill-up is detected by the fill-up detection sensor 156. When the fill-up is detected, by replacing the waste liquid storage unit 130 with a new waste liquid storage unit 130 and installing the new unit 130 again on the device housing 100, it is possible to use the image formation apparatus exceeding a life of the waste liquid absorption member 135 of the waste liquid storage unit 130. Moreover, the waste liquid storage unit 130 has a substantially sealed structure using the lid member 151 including the top plate 153, so that the waste liquid is not spilled out of the waste liquid storage container upon detaching the waste liquid storage unit 130 full of waste liquid.

By configuring the waste liquid storage container to be replaceable, it is possible to provide an image formation apparatus in which replacement is easy, maintenance is improved, and life of the device is prolonged.

Figure 31:
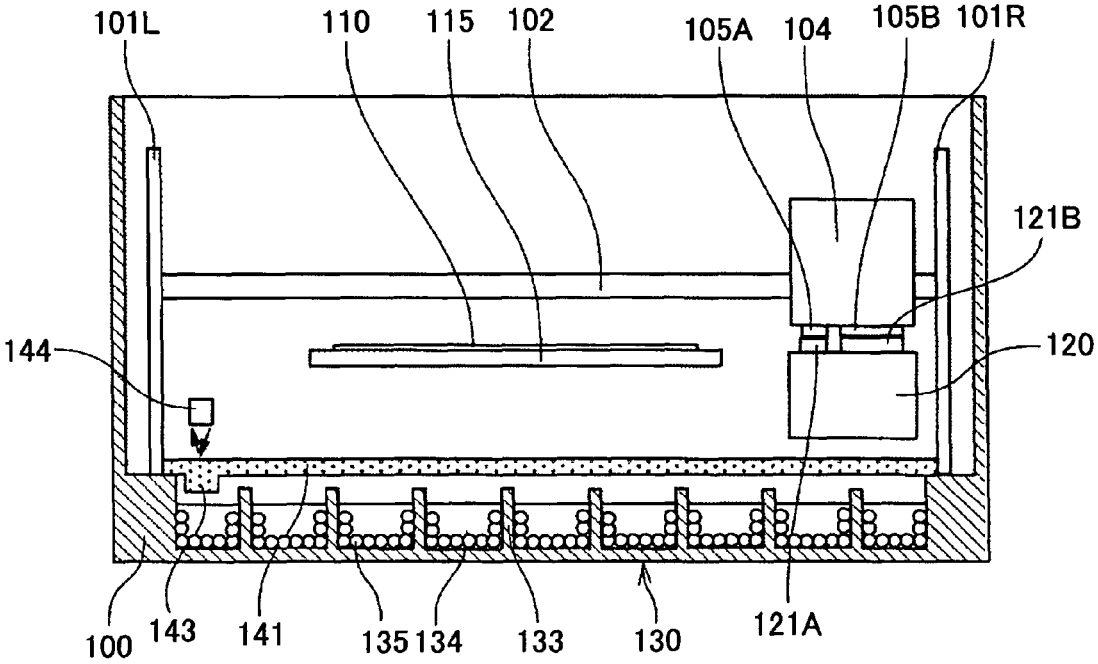
FIG. 31 is a schematic diagram showing a mechanism unit of a fourth embodiment of an image formation apparatus according to the present invention including a liquid discharge head according to the present invention.
Figure 32:
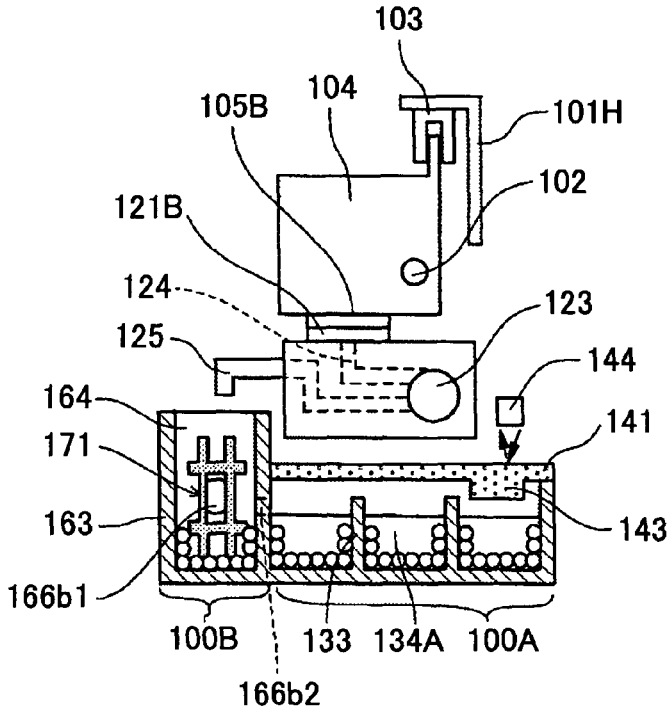
FIG. 32 is a diagram illustrating a right side of FIG. 31.
Figure 33:
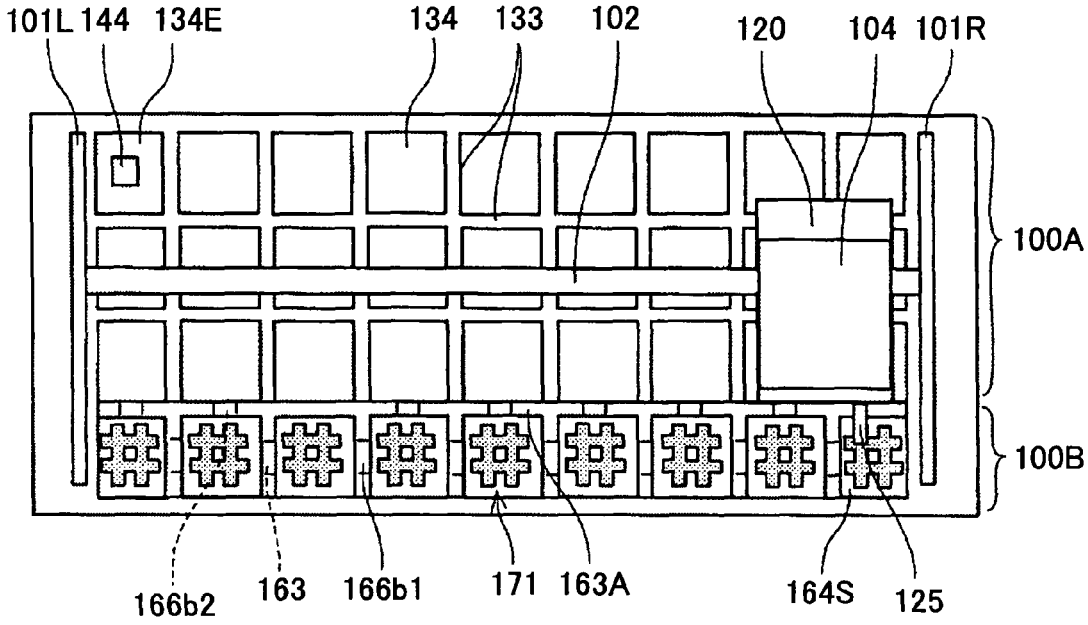
FIG. 33 is a plan view illustrating FIG. 31.

Next, a fourth embodiment of the image formation apparatus according to the present invention is described with reference to FIGS. 31 to 33. FIG. 31 is a schematic diagram showing a mechanism unit of the image formation apparatus. FIG. 32 is a diagram illustrating a right side of FIG. 31. FIG. 33 is a plan view illustrating FIG. 31.

A bottom of the device housing 100 of the image formation apparatus includes a relatively low portion (field) 100A and a relatively high portion (field) 100B on the front side. In the field 100A, a space is divided into plural segments 134 by the rib 133 having a height lower than a height of an outer wall portion of the device housing 100.

In the field 100A, in the same manner as in each of the above-mentioned embodiments, a space is divided into plural segments 134 by the rib 133 having the height lower than a height of an outermost wall portion. On a wall surface (bottom and side wall surface) of the segments 134, high water-absorbing polymers are adhered and fixed as the waste liquid absorption member 135 in a field lower than the upper end surface of the rib 133. Polyacrylic resin having an average particle size of 300 μm is used as the high water-absorbing polymers and chemically-modified starch is used so as to adhere and fix the high water-absorbing polymers.

The top plate 141 including white urethane foam is disposed on an upper surface of the field 100A. The top plate 141 forms the convex portion 143 at a lower side of a position for the segment 134E most distant from a position of the waste liquid tube 125 where the waste liquid is dropped and the fill-up detection sensor 144 is disposed for the convex portion 143.

Further, in the field 100B, a space is divided into plural segments 164 by a rib 163, a perforation 166*b*1 used as a communication portion is formed on the rib 163 between the segments 164, and a perforation 166*b*2 used as a communication portion is formed on a backside rib 163A (partition portion) between the segments 164 of the field 100B and the segments 134 of the field 100A. The waste liquid tube 125 faces a segment 164S in the field 100B.

Figure 34:
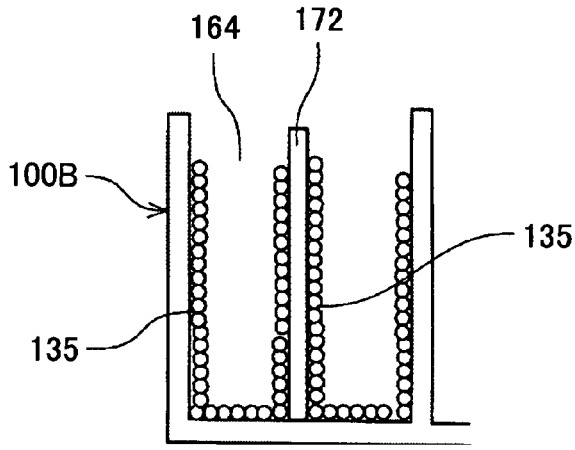
FIG. 34 is an enlarged cross-sectional view illustrating a main portion as another example.

In each of the segments 164 in the field 100B, a frame member 171 having a substantially cubic lattice shape is disposed inside each of the segments 164. The frame member 171 is formed by adhering and fixing high water-absorbing polymers on a surface of an ABS resin molded part using chemically-modified starch. Depending on a size of the segment 164 (opening area), it is possible to install a simple columnar member 172 in a standing manner in which high water-absorbing polymers are adhered and fixed on the surface using chemically-modified starch as shown in FIG. 34 instead of using the frame member 171.

In accordance with this structure, the waste liquid generated when the nozzle suction is performed as mentioned above is dropped via the waste liquid tube 125 to the segment 164S of the waste liquid storage unit (waste liquid storage container) 130 constructed on the bottom of the device housing 100. Accordingly, the dropped waste liquid is flown into the adjacent segments 164 and 134 from the perforations 166*b*1 and 166*b*2 of the relevant segment 164S (where the waste liquid is dropped), the waste liquid is further flown into the adjacent segments 134 over the rib 133 in a successive manner, and the flown waste liquid is absorbed in the waste liquid absorption member 135 of the segments 134 into which the waste liquid is flown. These operations are performed in a successive manner.

In this case, the frame member 171 to which the waste liquid absorption member 135 is attached is disposed inside the relatively high segments 164 in the field 100B on the front side of the apparatus, so that it is possible to absorb and store the waste liquid up to an upper space in the segments 164 and increase an amount of absorption of waste liquid.

Further, the top plate 141 including the porous body is disposed and the downward convex portion 143 is formed at the position most distant from the position where the waste liquid is dropped in the same manner as in the second embodiment, so that it is possible to detect the change of color of the top plate 141 using the fill-up detection sensor 144 when the waste liquid storage container becomes full of waste liquid and to accurately detect fill-up of waste liquid.

Figure 35:
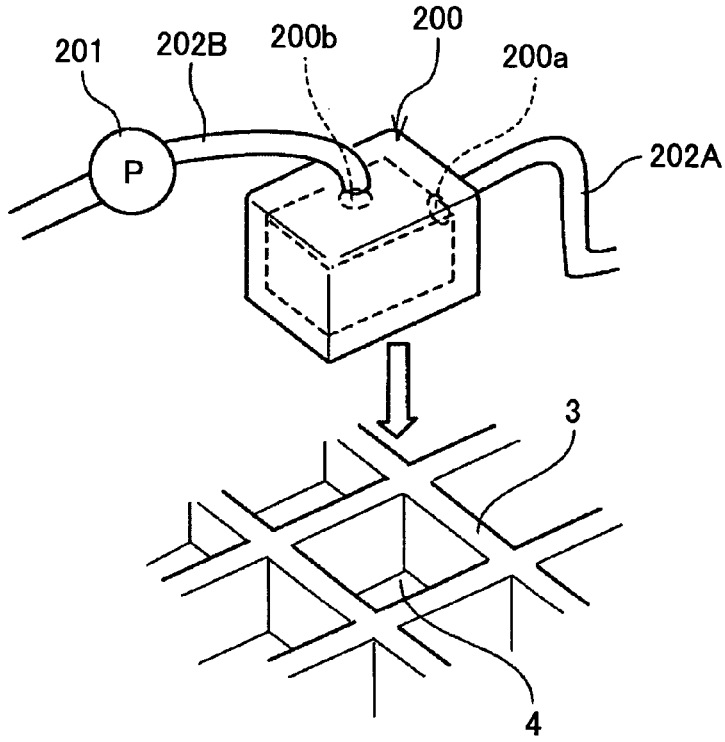
FIG. 35 is a perspective view illustrating a method and a device for recycling a waste liquid storage container used for illustrating an eleventh embodiment of a waste liquid storage container according to the present invention.
Figure 36:
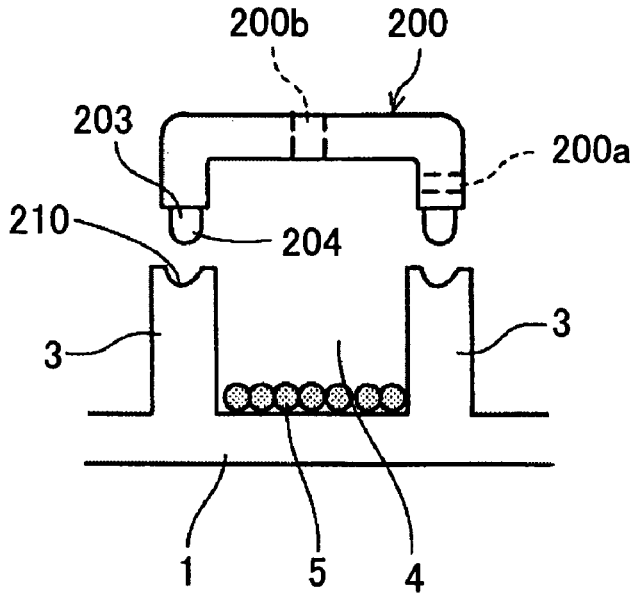
FIG. 36 is an enlarged view showing a rib portion of a waste liquid storage container according to the embodiment.

Next, an eleventh embodiment of the waste liquid storage container according to the present invention is described with reference to FIGS. 35 and 36. FIG. 35 is a perspective view illustrating a method and a device for recycling a waste liquid storage container. FIG. 36 is an enlarged view showing a rib portion of a waste liquid storage container according to the embodiment. Hatching for cross-sectional views in the enlarged views of the rib portion is omitted (the following is described in the same manner).

First, when the waste liquid storage container becomes full of waste liquid, although it is possible to dispose of the waste liquid storage container without performing any process, preferably, the waste liquid stored in the waste liquid storage container is removed and the waste liquid storage container is recycled. In this case, the waste liquid storage container according to the present invention absorbs the waste liquid in the waste liquid absorption member 5 such as high water-absorbing polymers. Thus, as shown in FIG. 35, for example, it is possible to employ a suction mechanism (method and device) in which the segment 4 is sealed by capping the segment 4 with a cap member 200 having a shape corresponding to each of the segments 4 and the waste liquid absorption member 5 that has absorbed the waste liquid in the segment 4 experiences suction by driving a pump 201 connected to the cap member 200 while the segment 4 is sealed.

In this case, a suction inlet 200*a* for performing suction of cleaning liquid via a tube 202A is disposed on the cap member 200 and the pump 201 is connected to a discharge outlet 200*b* via a tube 202B, for example, so that it is possible to perform suction and discharging of the cleaning liquid and the waste liquid absorption member 5 while performing suction of the cleaning liquid in the segment 4.

When performing suction and discharging of the waste liquid absorption member 5 of the waste liquid storage container using the cap member 200 as in this case, preferably, adhesion between the cap member 200 and the segment 4 is improved. In view of this, in the present embodiment, as shown in FIG. 36, a concave portion 210 is continuously formed on a top surface of the rib 3 constituting the partition portion around the segment 4 of the waste liquid storage container. The term "continuously" includes a case where the partition portion is partially blocked by the communication portion 6 formed on the top surface of the rib 3, for example. On the other hand, a convex portion 204 corresponding to the shape of the concave portion 210 of the rib 3 is formed on an abutment portion 203 of the cap member 200 to be brought into abutment with the top surface of the rib 3.

In accordance with this structure, when the cap member 200 is brought into close contact with the top surface of the rib 3 constituting the partition portion of each segment 4, the concave portion 210 and the convex portion 204 are fit into each other and brought into close contact with preferable sealing characteristics. Thus, it is possible to improve the adhesion between the cap member 200 and the partition portion of the segment 4 when performing suction and discharging of the waste liquid absorption member 5 of the waste liquid storage container using the cap member 200.

Figure 37:
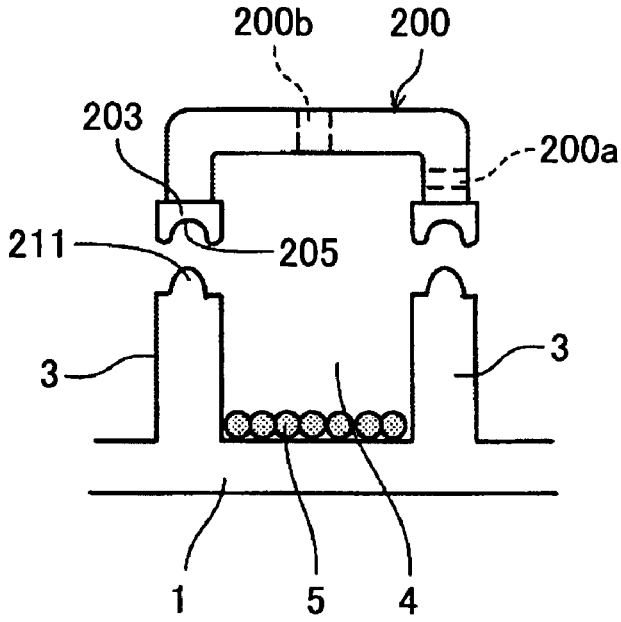
FIG. 37 is an enlarged view showing another example of the rib portion.
Figure 38:
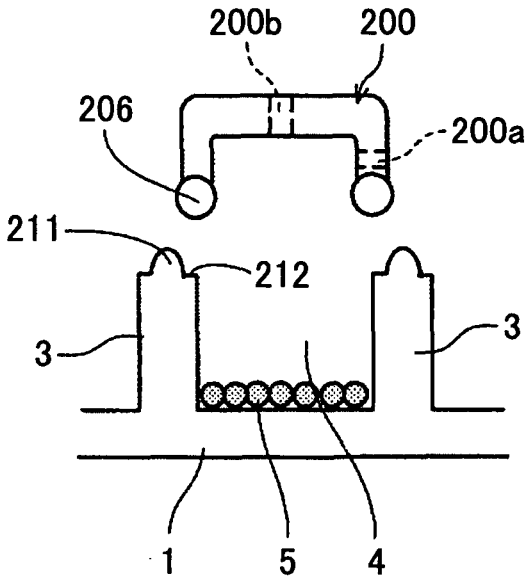
FIG. 38 is an enlarged view showing a cap member.

Next, another example of the eleventh embodiment is described with reference to FIGS. 37 and 38. FIG. 37 is an enlarged view showing another example of the rib portion of the waste liquid storage container according to the embodiment. FIG. 38 is an enlarged view showing another example of the cap member.

In this case, a convex portion (protrusion portion) 211 is continuously formed on the top surface of the rib 3 constituting the partition portion around the segment 4 of the waste liquid storage container. In accordance with this structure, as shown in FIG. 37, when a concave portion 205 corresponding to a shape of the convex portion 211 of the rib 3 is formed on the abutment portion 203, it is possible to improve adhesion. Further, as shown in FIG. 38, when an abutment portion 206 to be engaged with a step portion 212 formed on a segment 4 side of the convex portion 211 of the rib 3 is disposed on the cap member 200, it is also possible to improve adhesion.

Figure 39:
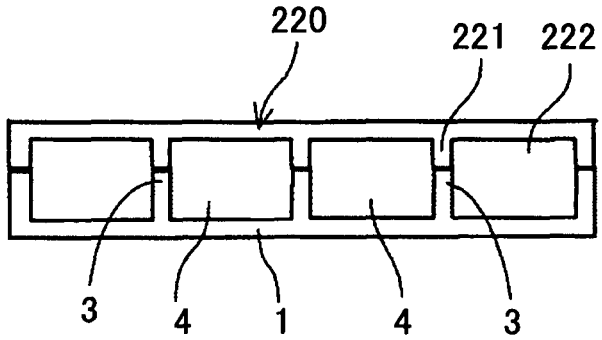
FIG. 39 is a schematic diagram used for illustrating another example of the cap member.
Figure 40:
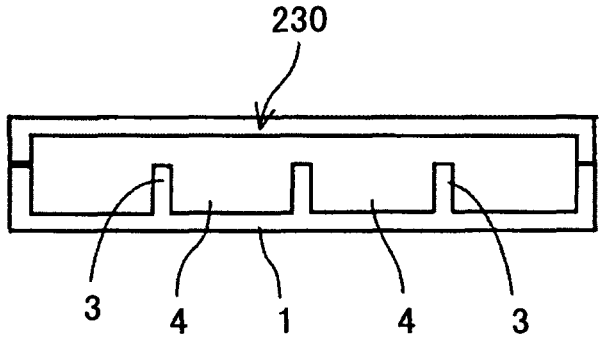
FIG. 40 is a schematic diagram used for illustrating yet another example of the cap member.

The cap member is not limited to the size or shape corresponding to each of the segments 4 of the waste liquid storage container as mentioned above. For example, as shown in FIG. 39, it is possible to use a cap member 220 capable of covering an entire portion of the segments 4 of the waste liquid storage container and having an inside where spaces 222 divided in accordance with each of the segments 4 by a rib 221 are formed. Moreover, as shown in FIG. 40, it is possible to use a cap member 230 having a shape capable of simply covering the entire portion of the segments 4 of the waste liquid storage container. However, in terms of efficiency of suction and discharging, preferably, the cap member has a shape corresponding to each of segments as shown in FIG. 35 or a shape whose inside is divided in accordance with each of segments as shown in FIG. 39.

In the above-mentioned embodiments, serial type (shuttle type) image formation apparatuses are described as the image formation apparatus according to the present invention. However, the present invention is not limited to this type. It is possible to apply the present invention to a line type image formation apparatus employing a line type head having a length corresponding to a width of paper in the same manner. Moreover, although the image formation apparatus is described using a printer structure, the present invention is not limited to this. For example, it is possible to apply the present invention to an image formation apparatus such as a multifunction device of printer/facsimile machine/copier, for example. Further, it is possible to apply the present invention to an image formation apparatus employing recording fluid, fixing process liquid, or the like as liquid other than ink. Moreover, the waste liquid storage container according to the present invention is not limited to those applied to an image formation apparatus as mentioned above. It is possible to apply the waste liquid storage container according to the present invention to a liquid discharge head and a liquid discharge device discharging liquid other than ink such as DNA samples, resist, pattern materials, and the like and to an image formation apparatus employing the liquid discharge head and the liquid discharge device.

The present invention is not limited to the specifically disclosed embodiment, and variations and modifications may be made without departing from the scope of the present invention.

The present application is based on Japanese priority application No. 2006-196768 filed Jul. 19, 2006, Japanese priority application No. 2007-034022 filed Feb. 14, 2007, the entire contents of which are hereby incorporated herein by reference.

What is claimed is:

1. A liquid discharge device comprising:

a liquid discharge head for discharging liquid;

a maintenance and recovery mechanism including a waste liquid dispensing member, the maintenance and recovery mechanism removing waste liquid from the liquid discharge head and dropping the waste liquid through the waste liquid dispensing member; and a waste liquid storage container for storing waste liquid of the liquid, wherein the waste liquid storage container includes:

a container body divided into plural segments;

a waste liquid absorption member disposed on each segment of the container body, the waste liquid absorption member being made of a high water-absorbing polymer or a high oil-absorbing polymer;

a partition portion dividing an internal space of the container body into plural adjacent container portions; and a communication portion formed on the partition portion, for the adjacent container portions to communicate with each other, wherein the communication portion is disposed at a position above the waste liquid absorption member, in a direction opposite to a dropping direction of the waste liquid dropping from the waste liquid dispensing member to the waste liquid storage container, so as not to be closed when the polymer is swelled.

2. A waste liquid storage container comprising:

a container body divided into plural segments; and a waste liquid absorption member disposed on each segment of the container body, the waste liquid absorption member being made of a high water-absorbing polymer or a high oil-absorbing polymer, wherein a frame member is disposed on the segment, the frame member having a waste liquid absorption member made of a high water-absorbing polymer or a high oil-absorbing polymer disposed thereon.

3. A waste liquid storage container comprising:

a container body divided into plural segments; and a waste liquid absorption member disposed on each segment of the container body, the waste liquid absorption member being made of a high water-absorbing polymer or a high oil-absorbing polymer, wherein a lid member for covering the container body is installed so as to be capable of sealing the container body, and at least a portion of the lid member is made of a porous material.

4. A waste liquid storage container configured to receive waste liquid dropped from a waste liquid dispensing member, said waste liquid storage container comprising:

a container body divided into plural segments;

a waste liquid absorption member disposed on each segment of the container body, the waste liquid absorption member being made of a high water-absorbing polymer or a high oil-absorbing polymer;

a partition portion dividing an internal space of the container body into plural adjacent container portions; and a communication portion formed on the partition portion, for communication by the adjacent container portions with each other, wherein the communication portion is disposed at a position above the waste liquid absorption member, in a direction opposite to a dropping direction of the waste liquid dropping from the waste liquid dispensing member to the waste liquid storage container, made of the polymer so as not to be closed when the polymer is swelled.

5. The waste liquid storage container according to claim 4, wherein a height of the partition portion dividing the internal space of the container body into the container portions is lower than a height of an outermost wall portion of the container body.

6. The waste liquid storage container according to claim 4, wherein a lid member for covering the container body is installed so as to be capable of sealing the container body.

7. The waste liquid storage container according to claim 4, wherein the polymer has a powder shape, flake shape, fibrous shape, gel shape, or fragment shape.

8. The waste liquid storage container according to claim 4, wherein the polymer is disposed on a wall surface of the segment.

9. The waste liquid storage container according to claim 4, wherein a step portion is continuously formed on an inner wall side of a top surface of the partition portion dividing the internal space of the container body into the container portions.

10. The waste liquid storage container according to claim 4, wherein the container body is constructed using a housing of a body of an apparatus including the waste liquid storage container.

11. The waste liquid storage container according to claim 4, wherein a concave portion or a convex portion is continuously formed on a top surface of the partition portion dividing the internal space of the container body into the container portions.

12. A waste liquid storage container comprising:

a container body divided into plural segments; and plural waste liquid absorption members disposed on the plural respective segment of the container body, each of the plural waste liquid absorption member being made of a high water-absorbing polymer or a high oil-absorbing polymer;

a partition portion dividing an internal space of the container body into plural adjacent container portions, each of the plural adjacent container portions including a corresponding one of the plural waste liquid absorption members; and a communication portion formed on the partition portion, for communication by one of the adjacent container portions including a corresponding one of the plural waste liquid absorption members with another one of the adjacent container portions including another corresponding one of the plural waste liquid absorption members.

13. The waste liquid storage container according to claim 12, wherein each of the plural container portions is adjacent to a corresponding one of the plural waste liquid absorption members, and the communication portion is provided for communication by the one of the plural container portions including the corresponding one of the plural waste liquid absorption members with another one of the plural container portions including another corresponding one of the plural waste liquid absorption members.

14. The waste liquid storage container according to claim 12, wherein the internal space of the container body is divided by a plurality of partition portions, and plural communication portions are formed on the plural respective partition portions.

* * * * *